US005868600A

United States Patent [19]

Watanabe

[11] Patent Number: 5,868,600

[45] Date of Patent: Feb. 9, 1999

[54] TOY CAR

[75] Inventor: Kazuhiko Watanabe, Urawa, Japan

[73] Assignee: Asahi Corporation, Tokyo, Japan

[21] Appl. No.: 837,680

[22] Filed: Apr. 21, 1997

[51] Int. Cl.[6] ..... A63H 17/39

[52] U.S. Cl. ..... 446/460; 446/456; 446/466; 446/462; 180/200

[58] Field of Search ..... 446/437, 436, 446/456, 462, 457, 460, 466, 468, 441, 442; 180/199, 200

[56] References Cited

U.S. PATENT DOCUMENTS

| | | | |
|---|---|---|---|
| 1,420,307 | 6/1922 | Delany | 180/200 |
| 1,473,369 | 11/1923 | Williams et al. | 180/200 |
| 1,626,630 | 5/1927 | Schnitzler | 180/200 |
| 1,639,054 | 8/1927 | Palmer | 180/200 |
| 2,638,995 | 5/1953 | Gottlieb | 180/200 |
| 3,029,886 | 4/1962 | Hansen | 180/200 |
| 3,120,398 | 2/1964 | Butterworth | 180/199 |
| 3,266,587 | 8/1966 | Roberts | 180/200 |
| 3,623,562 | 11/1971 | Pitra | 180/200 |
| 3,871,129 | 3/1975 | Tong | 446/437 |
| 4,846,758 | 7/1989 | Chou | 446/437 |
| 4,892,503 | 1/1990 | Kumazawa | 446/456 |
| 5,429,543 | 7/1995 | Tilbor et al. | 446/456 |

*Primary Examiner*—Robert A. Hafer
*Assistant Examiner*—Jeffrey D. Carlson
*Attorney, Agent, or Firm*—Dykema Gossett PLLC

[57] ABSTRACT

A toy car has a body with front and rear wheels, wheel support members with rightward/leftward travel wheels, and an elevating mechanism for lifting up and down the wheel support members in order to set the rightward/leftward travel wheels with respect to the body in positions higher than the front and rear wheels and positions which is lower than the front and rear wheels and in which the rightward/leftward travel wheels are in contact with the ground. When the wheel support members are in lifting-up positions, the front and rear wheels, not the rightward/leftward travel wheels, are in contact with the ground, and the toy car travels forward or backward. When the wheel support members are in lifting-down positions, the rightward/leftward travel wheels, not the front and rear wheels, are in contact with the ground, the toy car travels rightward or leftward.

14 Claims, 15 Drawing Sheets

TOY CAR

BACKGROUND OF THE INVENTION

1. Field of the Invention

The present invention relates to a toy car whose traveling direction can be instantly changed between forward, backward and other traveling directions.

2. Description of the Related Art

A steerable toy car is known as one whose traveling direction can be changed not only between forward and backward directions but also to another direction such as a lateral direction. In order to change the traveling direction of a toy car of this type, it is necessary to turn the toy car around with angling the front wheels. This entails the problems that a relatively long period of time and a wide space are required to change the traveling direction, and that a rapid change of the traveling direction cannot be performed.

SUMMARY OF THE INVENTION

It is an object of the present invention to provide a toy car whose traveling direction can be instantly changed between the forward, backward and other directions.

It is a further object of the present invention to provide a toy car whose traveling direction can be changed in a narrow space between the forward, backward and other directions.

In order to achieve the above objects, a toy car according to a first aspect of the present invention comprises:

a body having front wheels and rear wheels;

first wheel driving means for rotating the front or rear wheels or the front and rear wheels;

wheel holding means including rightward/leftward travel wheels for permitting the toy car to travel rightward and leftward, the rightward/leftward travel wheels having orientations different from those of the front and rear wheels;

second wheel driving means for rotating the rightward/leftward travel wheels; and elevating means for bringing the rightward/leftward travel wheels closer to the body than the front and rear wheels in order to enable the toy car to travel on the front and rear wheels, and for driving the wheel holding means so as to protrude the rightward/leftward travel wheels more than the front and rear wheels in order to enable the toy car to travel on the rightward/leftward travel wheels.

With the above-described structure, the traveling direction can be rapidly changed even in a narrow space; for example, while the toy car is traveling forward/backward on the front and rear wheels, the right and left wheels are grounded so that the toy car travels rightward/leftward.

Moreover, the first wheel driving means of the toy car may include means for rotating a right wheel and a left wheel among the front and rear wheels in opposite directions. By making the rotational directions of those right and left wheels opposite to each other, change of the traveling direction (a turn) can be rapidly performed.

The first wheel driving means includes, for example, at least one first motor which is rotatable in a normal direction and a reverse direction and first rotation transmission means for transmitting the rotation of the at least one first motor to the front or rear wheels or to the front and rear wheels.

The second wheel driving means includes, for example, a second motor which is rotatable in the normal direction and the reverse direction and second rotation transmission means for transmitting the rotation of the second motor to the rightward/leftward travel wheels.

The elevating means includes, for example, driving means for converting rotations, in the normal and reverse directions, of the first motor to rotations in the same direction and for driving the wheel support members with the converted rotations so that the rightward/leftward travel wheels approach the body, and means for converting rotations, in the normal and reverse directions, of the second motor to rotations in the same direction and for driving the wheel support members with the converted rotations so that the rightward/leftward travel wheels separate from the body.

With the above structure, change of the positions of the wheels through the use of wheel driving motors is also possible.

The wheel holding means includes, for example, two wheel support members arranged at the body horizontally and in parallel with each other.

Each of the wheel support members has two ends, one end being supported on the body by a support shaft and the other end holding one of the rightward/leftward travel wheels.

The elevating means has a structure for rotating each wheel support member around its support shaft.

The first wheel driving means includes, for example, at least one first motor which is rotatable in the normal direction and the reverse direction and first rotation transmission means for transmitting the rotation of the at least one first motor to the front or rear wheels or to the front and rear wheels.

The second wheel driving means includes, for example, a second motor which is rotatable in the normal direction and the reverse direction and second rotation transmission means for transmitting the rotation of the second motor to the rightward/leftward travel wheels.

The elevating means includes a first changeover mechanism for converting rotations, in the normal and reverse directions, of the at least one first motor to rotations in the same direction, means for rotating each wheel support member with the rotations converted by the first changeover mechanism so that the aforementioned other end approaches the body, a second changeover mechanism for converting rotations, in the normal and reverse directions, of the second motor to rotations in the same direction, and means for rotating each wheel support member with the rotations converted by the second changeover mechanism so that the aforementioned other end separates from the body.

The first changeover mechanism includes a first driving gear which is rotated by the at least one first motor, a first driven gear and a first intermediate gear which are in mesh with each other, and a first planetary gear which is in mesh with the first driving gear, the first planetary gear being in mesh with the first intermediate gear while the at least one first motor is rotating in the normal direction and being in mesh with the first driven gear while the second motor is rotating in the reverse direction.

The second changeover mechanism includes a second driving gear which is rotated by the second motor, a second driving gear and a second intermediate gear which are in mesh with each other, and a second planetary gear which is in mesh with the second driven gear, the second planetary gear being in mesh with the second intermediate gear while the second motor is rotating in the normal direction and being in mesh with the second driven gear while the second motor is rotating in the reverse direction.

The rear wheels are supported on the body by separate axles.

The first wheel driving means includes, for example, rotation means for rotating the other rear wheel in the same direction as a rotational direction of the aforementioned one rear wheel, body turning means for turning the body by rotating the aforementioned other rear wheel in a different direction from the rotational direction of the aforementioned one rear wheel, and selection means for coupling the aforementioned other rear wheel selectively to the rotation means and the body turning means.

The elevating means includes, for example, a first driven gear to which the rotation of the first motor is transmitted, a second driven gear to which the rotation of the second motor is transmitted, first and second pinions which are in mesh with the first and second driven gears, a sector rack on an outer circumference of which first and second tooth portions, capable of engaging with and disengaging from the first and second pinions, are formed with being spaced from each other and which is formed on one of the wheel support members, and gears formed on those side surfaces of the wheel support members which face each other, and being in mesh with each other.

The toy car may further comprise a resilient member for keeping the wheel support members in the lifting-up or lifting-down positions.

The toy car may be controlled with radio waves.

In this case, the following, for example, are further arranged:

a control box having an instruction section, operated by a user, for giving instructions on movements of the toy car, and sending means for converting an instruction input to the instruction section to a radio signal and sending out the radio signal;

demodulating means, arranged in the body, for receiving the radio signal from the sending means and demodulating an operation instruction; and control means for controlling the first and second wheel driving means and the elevating means in accordance with the operation instruction demodulated by the demodulating means.

A toy car according to a second aspect of the present invention comprises:

a body;

first wheels oriented in a first direction;

second wheels oriented in a second direction different from the first direction; and a changeover section for holding the second wheels and keeping the second wheels in positions which are switched between first positions in which the second wheels protrude more than the first wheels and second positions in which the second wheels are closer to the body than the first wheels.

According to the above-described structure, the traveling direction can be rapidly changed with grounding the first and second wheels alternately.

The toy car may further comprise driving means for driving the second wheels when the changeover section keeps the second wheels in the first positions, and for driving the first wheels when the changeover section keeps the second wheels in the second positions.

The driving means includes, for example, at least one first motor for driving the first wheels, first transmission means for transmitting the rotation of the at least one first motor to the first wheels, a second motor for driving the second wheels, and second transmission means for transmitting the rotation of the second motor to the second wheels.

The changeover means includes, for example, means for driving the second wheels up to the second positions with the rotation of the first motor, and means for driving the second wheels up to the first positions with the rotation of the second motor.

The driving means may include means for making rotary directions of at least two of the first wheels opposite to each other.

PREFERRED EMBODIMENTS

Preferred embodiments of the present invention will now be described with reference to the drawings.

First Embodiment

The toy car according to the first embodiment has wheels 2 and 3 for forward/backward traveling and right and left wheels 8 for rightward/leftward traveling, and switching between the forward, backward, rightward and leftward traveling can be performed.

Figure 1:
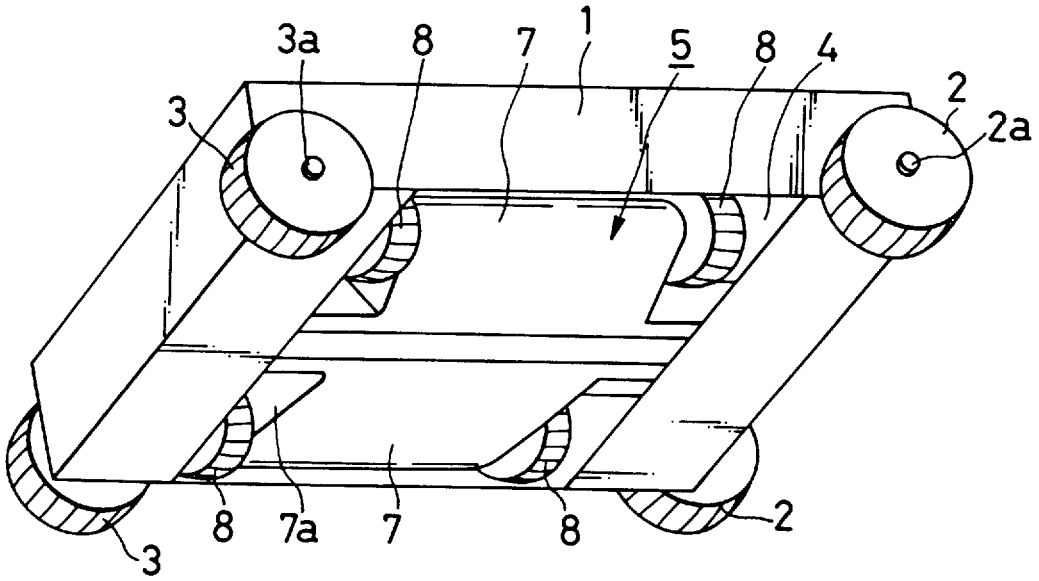
FIG. 1 is a perspective view of a toy car according to a first embodiment of the present invention when the wheel support members are in the lifting-up positions.
Figure 2:
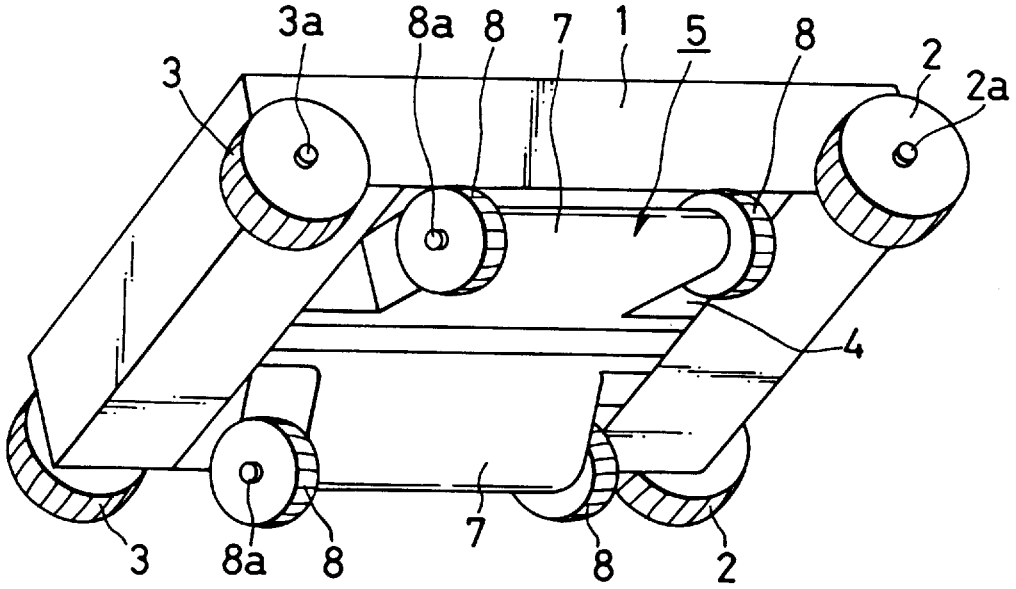
FIG. 2 is a perspective view of the toy car according to the first embodiment of the present invention when the wheel support members are in the lifting-down positions.

This toy car has a body 1 and an elevating device 5 as shown in FIGS. 1 and 2.

The body 1 constitutes the main body of the toy car, and is formed in a shape similar to that of an automobile or the like. A pair of front wheels 2 are arranged at both side surfaces of a front end portion of the body 1 so that the front wheels 2 can be rotated on their central axes by an axle 2*a*. A pair of rear wheels 3 are arranged at both side surfaces of a rear end portion of the body 1 so that the rear wheels 3 can be rotated on their central axes by an axle 3*a*.

A housing 4 like an opening is formed in the lower surface of the body, and the elevating device 5 is housed therein.

Figure 3:
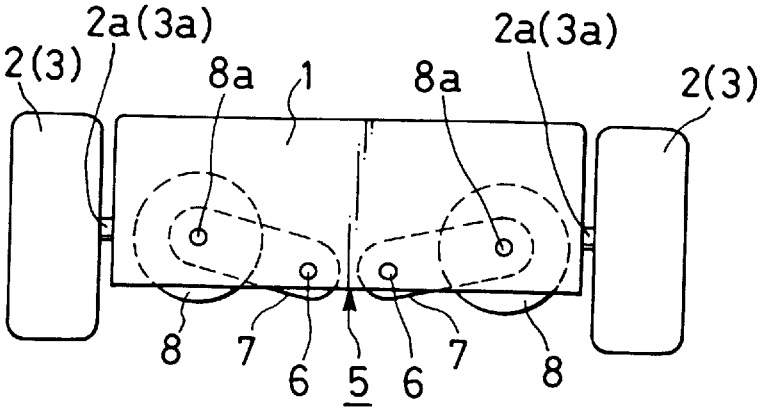
FIG. 3 is a front view of FIG. 1.
Figure 4:
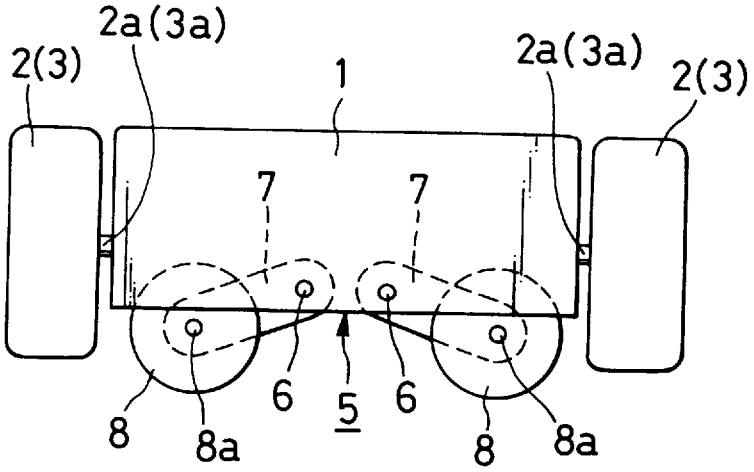
FIG. 4 is a front view of FIG. 2.

The elevating device 5 is one for lifting up and down the right and left wheels 8. As shown in FIGS. 3 and 4, the elevating device 5 includes two, right and left, wheel support members 7. The front and rear ends of the proximal portions of the individual wheel support members 7 are pivotally supported by support shafts 6 on the general center portions o f the front and rear inner walls of the housing 4. The right and left wheels 8 for the rightward/leftward traveling are rotatably supported by axles 8*a* on the free ends of the wheel support members 7.

Figure 5:
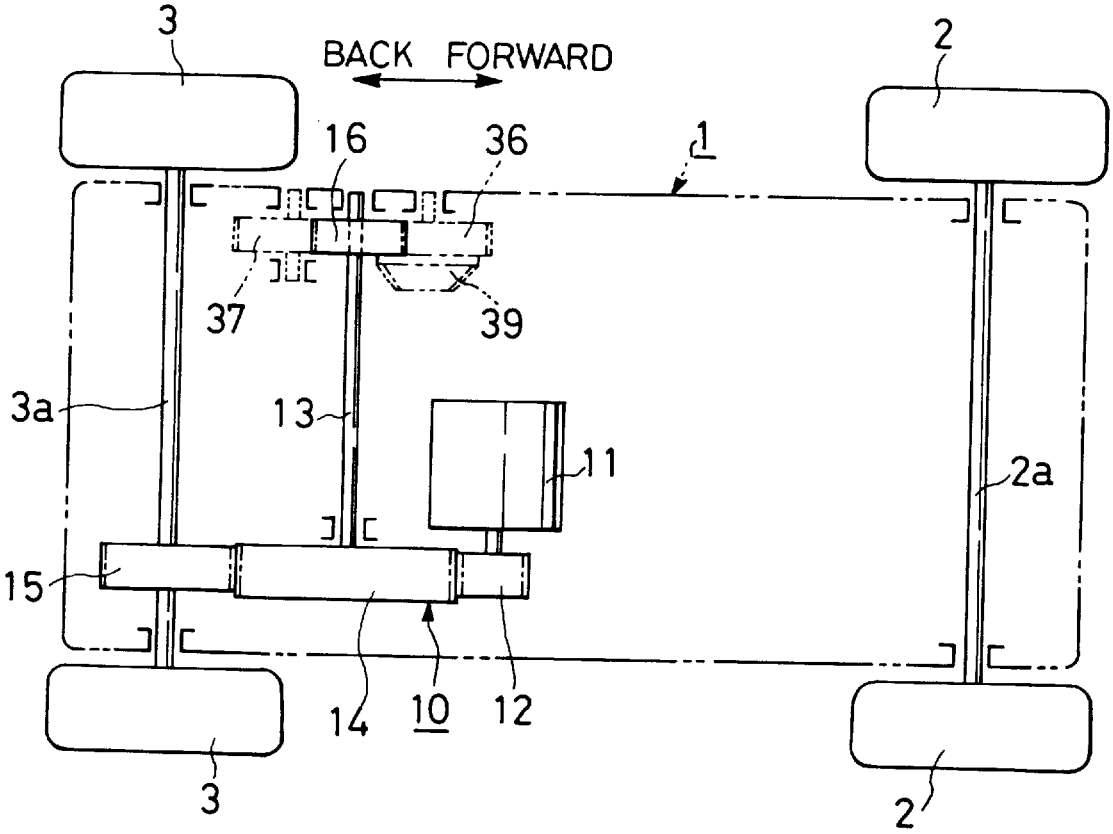
FIG. 5 is a schematic plan view of an embodiment of a wheels driving device according to the present invention.

The rear wheels 3 are driven by a rear-wheels driving device 10 as shown in FIG. 5. The rear-wheels driving device has ear-wheels driving motor 11 fixed to the body 1. A driving gear 12 is fixed to an output shaft of the rear-wheels driving motor 11. A driven gear 15 is fixed to an axle 3*a* for the rear wheels 3. A decelerating intermediate gear 14 is in mesh with both of the gears 12 and 15. This intermediate gear 14 is fixed to one end of a rotary shaft 13 which extends laterally with respect to the body 1 and which is rotatably supported by the body 1. The rotation of the motor 11 is transmitted to the rear wheels 3 with the rotation being decelerated through the gears 12, 14, 15 and the axle 3*a*.

Figure 6:
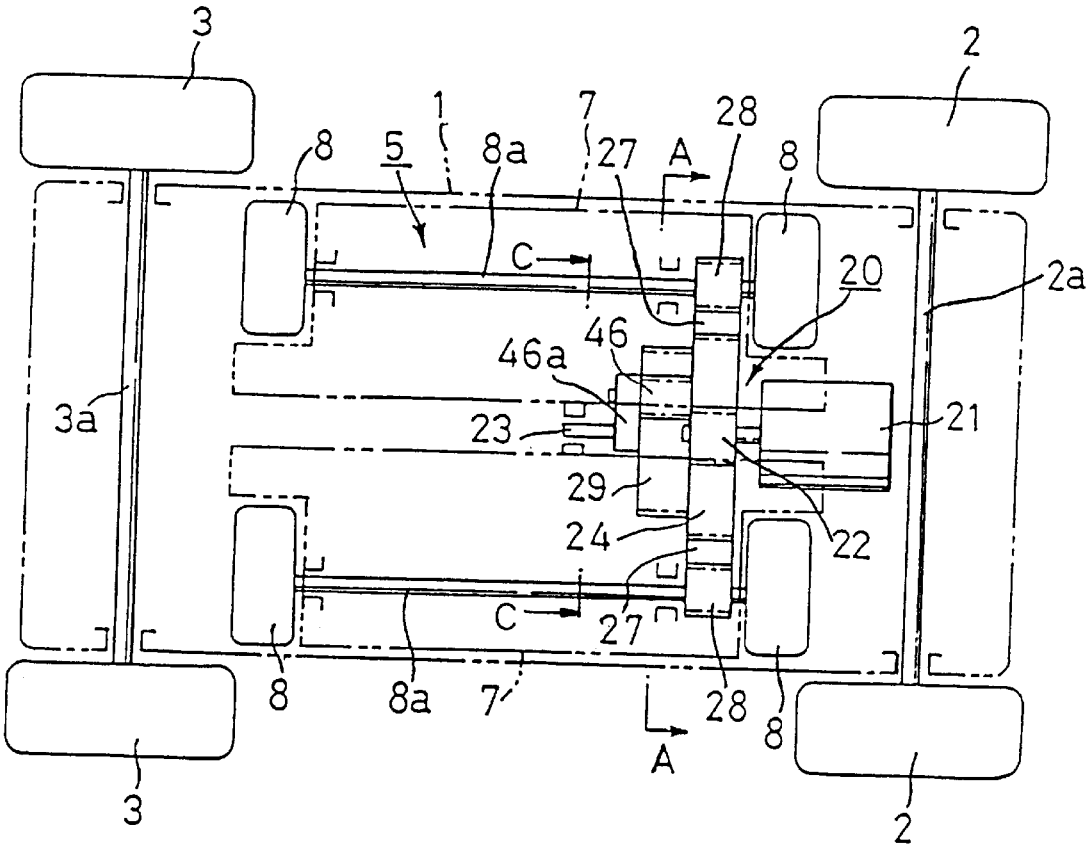
FIG. 6 is a schematic plan view of a rightward/leftward travel wheels driving device according to the present invention.
Figure 7:
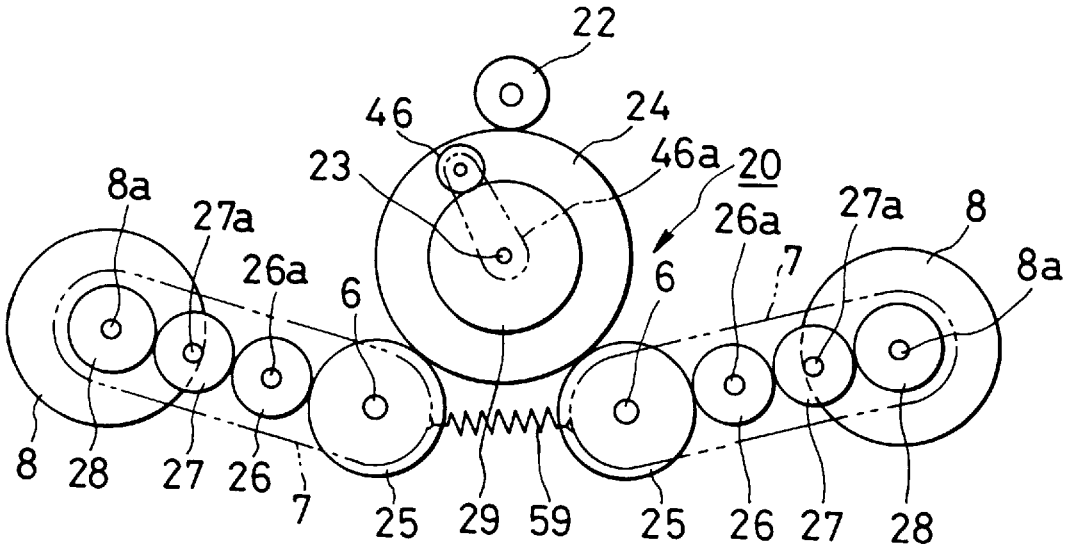
FIG. 7 is a section along line A—A shown in FIG. 6 when the wheel support members are in the lifting-up positions.
Figure 8:
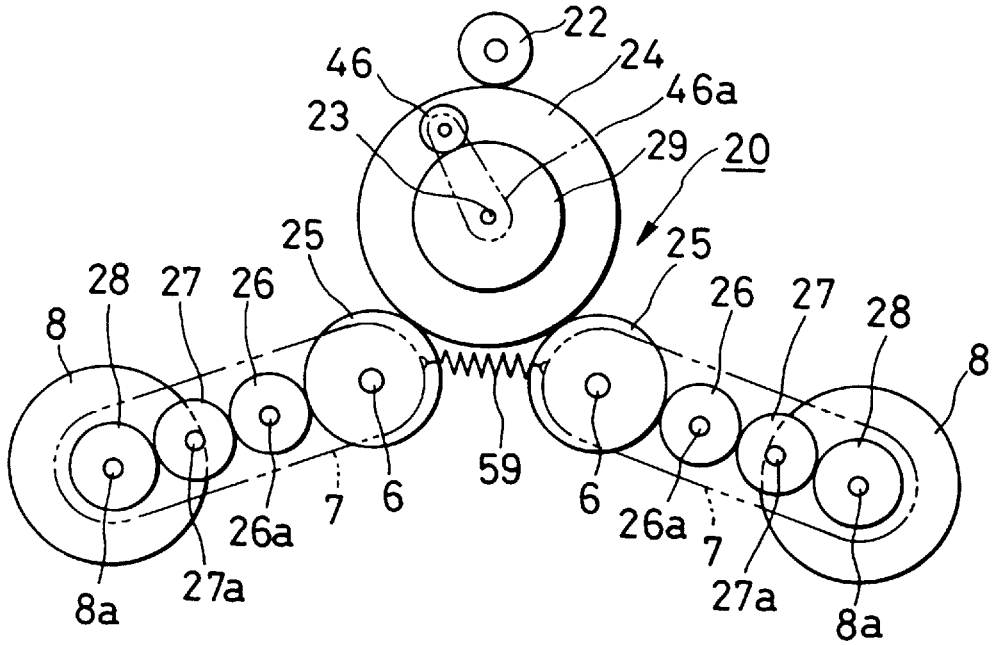
FIG. 8 is a section along line A—A shown in FIG. 6 when the wheel support members are in the lifting-down positions.

The right and left wheels 8 are driven by a rightward/leftward travel wheels driving device 20 as shown in FIG. 6. The rightward/leftward travel wheels driving device 20 has a rightward/leftward travel wheels driving motor 21 fixed to the body 1. A driving gear 22 i s fixed to an output shaft of the motor 21. As shown in FIGS. 6 to 8, a decelerating intermediate gear 24 is fixed to a rotary shaft 23 which is rotatably supported by the body 1, and is in mesh with the driving gear 22. Driven gears 28 are fixed to the axles 8*a* for the right and left wheels 8. Transmission gears 25 which are in mesh with the intermediate gear 24 are rotatably supported by the support shafts 6 of the wheel support members 7.

As shown in FIGS. 7 and 8, the transmission gears 25 and the driven gears 28 are connected with intermediate gears 26 and 27 therebetween which are rotatably supported by support shafts 26*a* and 27*a* on the wheel support members 7. The rotation of the motor 21 is transmitted to the four right and left wheels 8 with the rotation being decelerated through the gears 22, 24, 25, 26, 27, 28 and the axles 8*a*.

A coil spring 59 is provided between those surfaces of the wheel support members 7 which face each other. The coil spring 59 keeps the wheel support members 7 with its biasing force in the lifting-up positions shown in FIG. 7 or in the lifting-down positions shown in FIG. 8. When the wheel support members 7 are in the lifting-up positions, the right and left wheels 8 are located at higher levels than the front wheels 2 and the rear wheels 3, and the front and rear wheels 2 and 3 are in contact with the ground, while when the wheel support members 7 are in the lifting-down positions, the right and left wheels 8 are in contact with the ground.

A changeover device 30 causes the elevating device 5 to switch the position.

Figure 11:
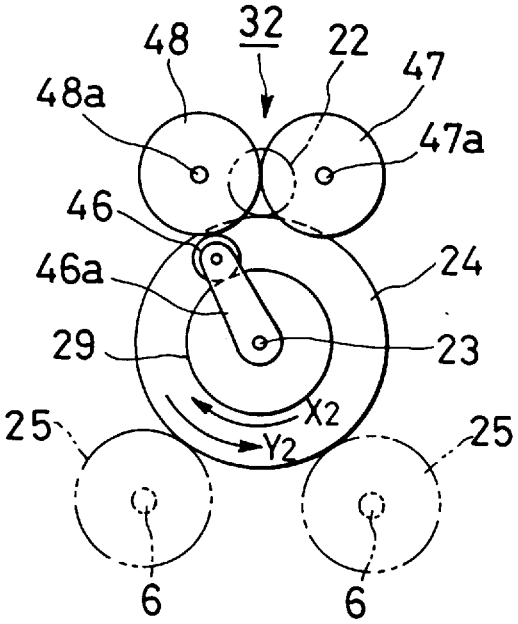
FIG. 11 is a section along line C—C shown in FIG. 6
Figure 12:
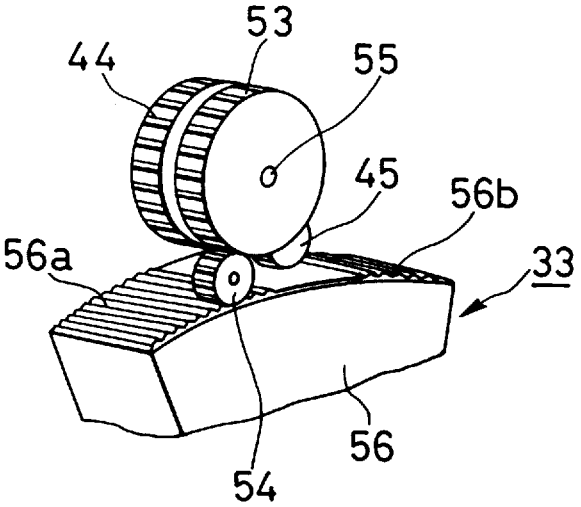
FIG. 12 is a schematic perspective view showing the state of the engagement between a transmission gear, pinions and a rack of the changeover driving device illustrated in FIG. 9.
Figure 13:
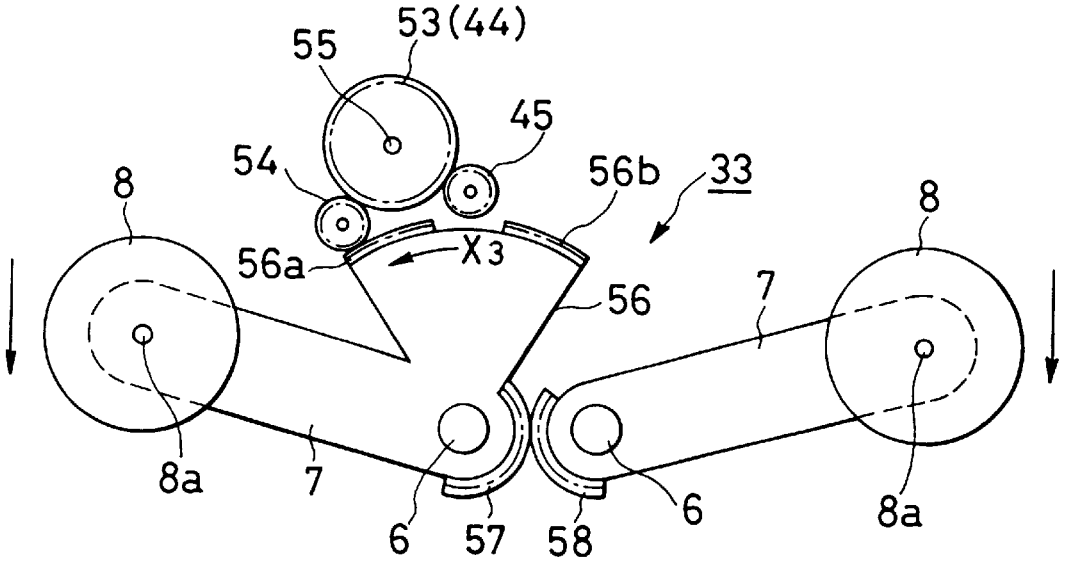
FIG. 13 is a diagram illustrating the elevating mechanism of the present invention and a front view of the wheel support members set in the lifting-up positions by the elevating mechanism.
Figure 14:
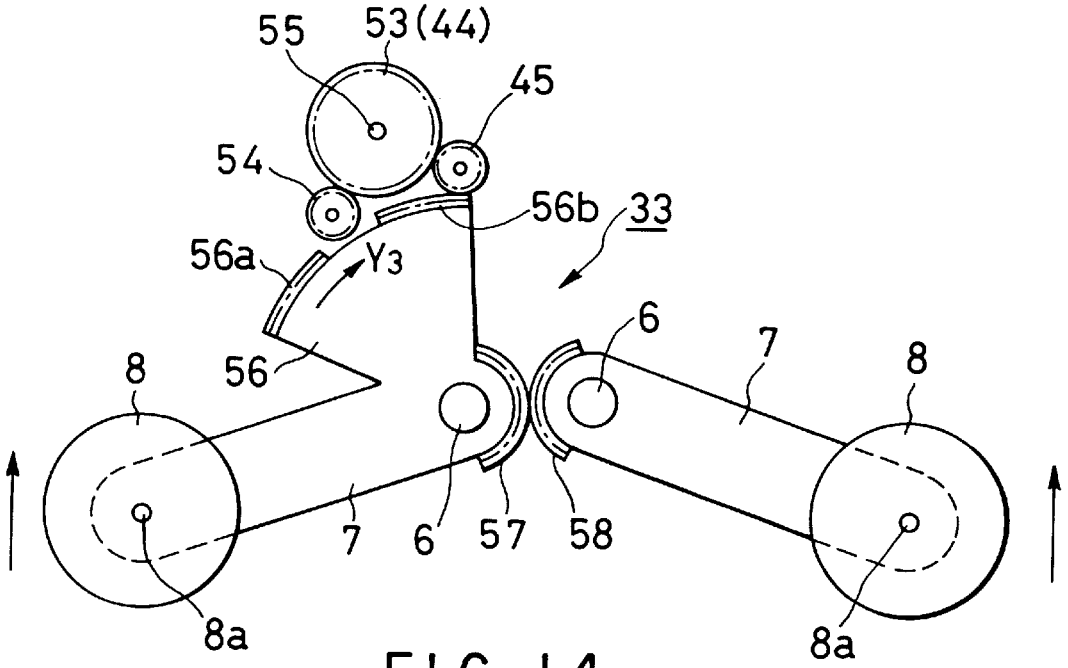
FIG. 14 is a diagram illustrating the elevation mechanism of the present invention and a front view of the wheel support members set in the lifting-down positions by the elevating mechanism.

The changeover device 30 includes a first transformation mechanism 31, a second transformation mechanism 32 (FIGS. 9 to 11) and an elevating mechanism 33 (FIGS. 12 to 14).

The first transformation mechanism 31 transforms the rotation of the rear-wheels driving motor 11 to a rotation in a specific direction whether the rotation of the motor 11 is that in the normal (forward) direction or that in the reverse direction, and causes the elevating mechanism 33 to lift up the wheel support members 7. The second transformation mechanism 32 transforms the rotation of the motor 21 to a rotation in a direction reverse to that of the rotation transformed by the first transformation mechanism 31, and causes the elevating mechanism 33 to lift down the wheel support members 7.

Figure 9:
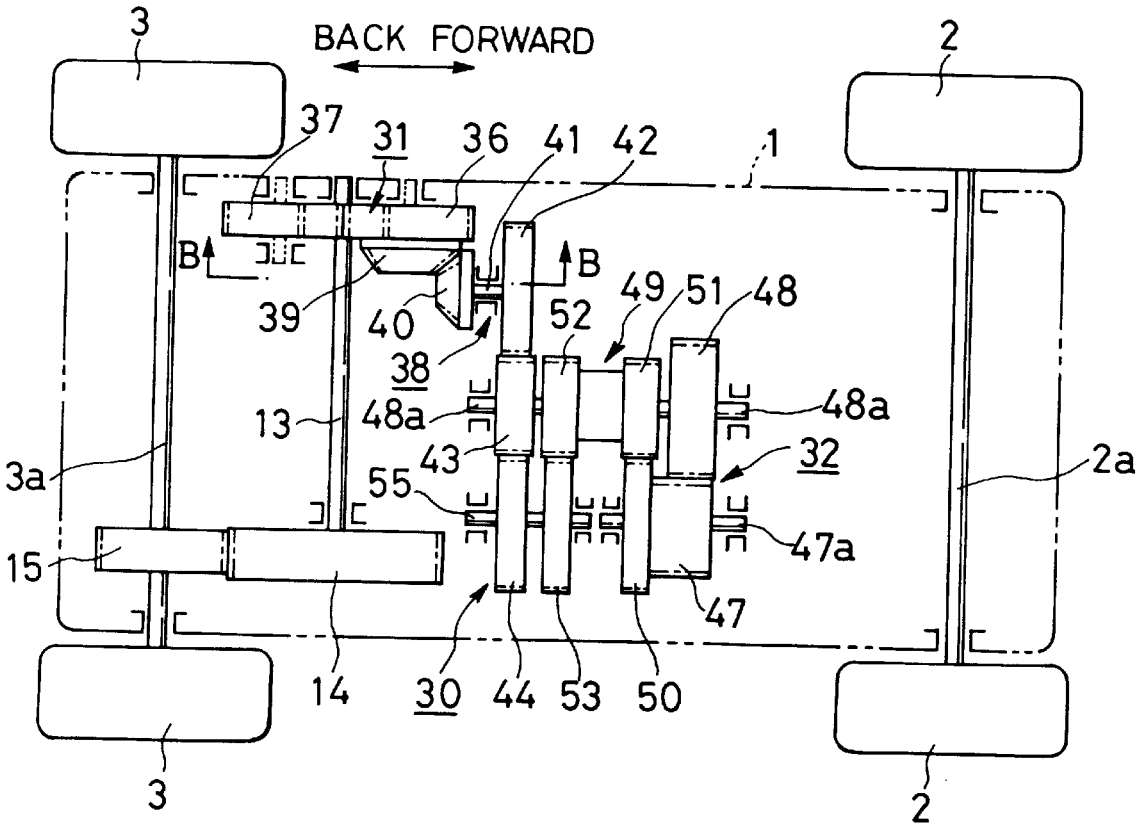
FIG. 9 is a schematic plan view of a changeover driving device according to the present invention.
Figure 10:
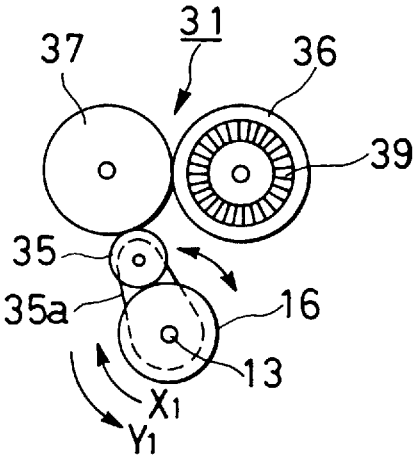
FIG. 10 is a section along line B—B shown in FIG. 9.

The first transformation mechanism 31 has a transformation gear 16, as shown in FIGS. 9 and 10. The gear 16 is fixed to the rotary shaft 13 of the rear-wheels driving device 10, as shown in FIG. 5. The transformation gear 16 rotates in the normal (forward) direction represented by an arrow Y1 in FIG. 10 and in the reverse direction represented by an arrow X1. A planetary gear 35 is in mesh with the transformation gear 16, and the gears 16 and 35 are pivotally supported by their rotary shafts on both end portions of an arm 35*a*.

A driven gear 36 and an intermediate gear 37 are arranged side by side and in mesh with each other, with facing the planetary gear 35. When the transformation gear 16 rotates in the direction of the arrow X1, the planetary gear 35 meshes directly with the driven gear 36 and rotates that gear. When the transformation gear 16 rotates in the direction of the arrow Y1, the planetary gear 35 meshes with the intermediate gear 37, and the driven gear 36 rotates in accordance with the rotation of the intermediate gear 37. According to this structure, the driven gear 36 rotates always in one direction (the same direction as that of the arrow X1 in FIG. 10) whether the transformation gear 16 rotates in the normal direction or the reverse direction.

The rotation of the driven gear 36 is transmitted to the elevating mechanism 33 (FIG. 13, FIG. 14) by a rotation transmission mechanism 38 (FIG. 9). As shown in FIG. 9, the rotation transmission mechanism 38 has a driving bevel gear 39 formed integrally and coaxially with the driven gear 36. A driven bevel gear 40 which is perpendicular to the driving bevel gear 39 is in mesh therewith. A first intermediate gear 42 is fixed to a rotary shaft 41 of the driven bevel gear 40. A second intermediate gear 43 is mounted on a rotary shaft 48*a* which is rotatably arranged at the body 1 in parallel with the rotary shaft 41, and is in mesh with the first intermediate gear 42. A rotation transmission gear 44 is mounted on a rotary shaft 55 which is rotatably arranged at the body 1 in parallel with the rotary shaft 48*a*, and is in mesh with the second intermediate gear 43. As shown in FIGS. 12 and 14, a pinion 45 is in mesh with the rotation transmission gear 44.

As shown in FIG. 11, the second transformation mechanism 32 has a driving transformation gear 29. As shown in FIG. 6, the driving transformation gear 29 is formed integrally with the intermediate gear 24 of the rightward/leftward travel wheels driving device 20, and rotates in the direction (the normal direction) of an arrow Y2 or in the direction (the reverse direction) of an arrow X2 upon the rotation of the motor 21. A planetary gear 46 is in mesh with the driving transformation gear 29. The driving transformation gear 29 and the planetary gear 46 are pivotally supported on both end portions of an arm 46*a* by the rotary shaft 23 and the rotary shaft of the planetary gear 46.

A driven gear 47 and an intermediate gear 48 are arranged side by side and in mesh with each other on the opposite side of the planetary gear 46 from the driving transformation gear 29. When the driving transformation gear 29 rotates in the direction of the arrow X2, the planetary gear 46 meshes with the driven gear 47 and rotates that gear. When the driving transformation gear 48 rotates in the direction of the arrow Y2, the planetary gear 46 meshes with the intermediate gear 48, and the rotation of the driving transformation gear 29 is transmitted to the driven gear 47 through the intermediate gear 48. Consequently, the driven gear 47 rotates always in the same direction (the same direction as that of the arrow X2 in FIG. 11) whether the driving transformation gear 29 rotates in the normal direction or the reverse direction.

As shown in FIG. 9, a traveling direction changeover transmission mechanism 49 is provided between the changeover device 30 and the second transformation mechanism 32. The traveling direction changeover transmission mechanism 49 includes a first transmission gear 50, a first intermediate gear 51, a second intermediate gear 52, a second transmission gear 53 and a pinion 54 (FIGS. 12 to 14). The first transmission gear 50 is formed integrally with the driven gear 47. The first intermediate gear 51 is rotatably and coaxially mounted on the rotary shaft 48*a* of the intermediate gear 48, and is in mesh with the first transmission gear 50. The second intermediate gear 52 has the same outer diameter as the second intermediate gear 43 of the rotation transmission mechanism 38 and the teeth of the same number as those of the second intermediate gear 43, and is provided integrally and coaxially with the first intermediate gear 51. The second transmission gear 53 has the same outer diameter as the rotation transmission gear 44 of the rotation transmission mechanism 38 and the teeth of the same number as those of the rotation transmission gear 44, and is rotatably and coaxially provided on the rotary shaft 55. The pinion 54 is in mesh with the second transmission gear 53 as shown in FIGS. 12 to 14.

The elevating mechanism 33 included in the changeover device 30 has the structure shown in FIGS. 13 and 14. More specifically, an upwardly broadening sector rack 56 is formed on one of the pair of wheel support members 7 (the left-hand wheel support member in the above drawings). Sector gears 57 and 58 are formed on those surfaces (inner surfaces) of the wheel support members 7 which face each other. Tooth portions 56*a* and 56*b* are formed on the right and left edge portions of the upper surface (the surface arcing around one support shaft 6) of the sector rack 56. As shown in FIG. 12, the tooth portions 56*a* and 56*b* are formed thicker than the combination of the rotation transmission gear 44 and the second transmission gear 53.

FIG. 13 shows the state wherein the wheel support members 7 have taken the lifting-up positions, while FIG. 14 shows the state wherein the wheel support members 7 have taken the lifting-down positions to lift down the rightward/leftward travel wheels 8. When the wheel support members 7 are in the lifting-up positions, the pinion 54 is in mesh with the tooth portion 56*a*, whereas the pinion 45 is not in mesh with the tooth portion 56*a* or 56*b*. On the other hand, when the wheel support members 7 are in the lifting-down positions, the pinion 45 is in mesh with the tooth portion 56*b*, whereas the pinion 54 is not in mesh with the tooth portion 56*a* or 56*b*. In the pinion out-of-mesh state described above, the coil spring 59 keeps the wheel support members 7 in the lifting-up positions or the lifting-down positions.

According to the above structure, the front wheels 2 and the rear wheels 3 are in contact with the ground when the wheel support members 7 are in the lifting-up positions. By driving the motor 11 under that condition, motive power is transmitted to the rear wheels 3, and the body 1 travels forward or backward.

The right and left wheels are in contact with the ground when the wheel support members 7 are in the lifting-down positions. When the motor 21 is driven under that condition, the left and right wheels 8 are driven, and the body 1 travels rightward or leftward.

When the motor 21 is rotated under the condition wherein the wheel support members 7 are in the lifting-up positions, the right and left wheels 8 are driven, and the changeover device 30 rotates the wheel support members 7 downward up to the lifting-down positions. Accordingly, the right and left wheels 8 descend with rotating, and the body 1 travels rightward or leftward upon grounding of the right and left wheels 8.

When the motor 11 is rotated under the condition wherein the wheel support members 7 are in the lifting-down positions, the front wheels 2 and rear wheels 3 are driven, and the changeover device 30 rotates the wheel support members 7 upward up to the lifting-up positions. Accordingly, the front wheels 2 and the rear wheels 3 come into contact with the ground with rotating, and the body 1 travels forward or backward upon grounding of the front and rear wheels.

Figure 15:
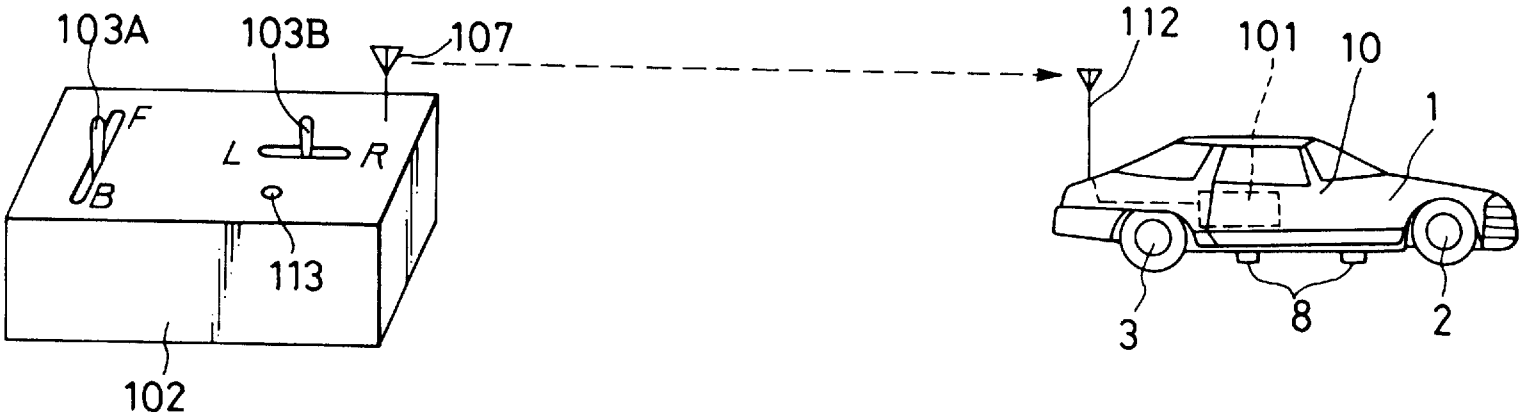
FIG. 15 is a conceptual diagram when the toy car of the present invention is controlled with radio waves.

As shown in FIG. 15, the toy car 1 includes a control device 101 which has a receiving section in the body 1, and is driven by a remote control with a control box 102. The control box 102 has a joystick 103A for giving an instruction to travel forward (F) or backward (B), a joystick 103B for giving an instruction to travel leftward (L) or rightward (R), and a turning button 113.

The control box 102 stays the toy car while the joysticks 103A and 103B are standing upright.

When the joystick 103A is tilted in an F (Forward) or B (Back) direction, the toy car is moved forward or backward at the speed according to the tilt angle.

When the joystick 103B is tilted in an L or R direction, on the other hand, the toy car is moved rightward or leftward at the speed according to the tilt angle.

In a second embodiment, the turning button 113 is operated to rapidly change the traveling direction by turning the toy car. This will be described in detail with reference to the second embodiment.

Figure 16:
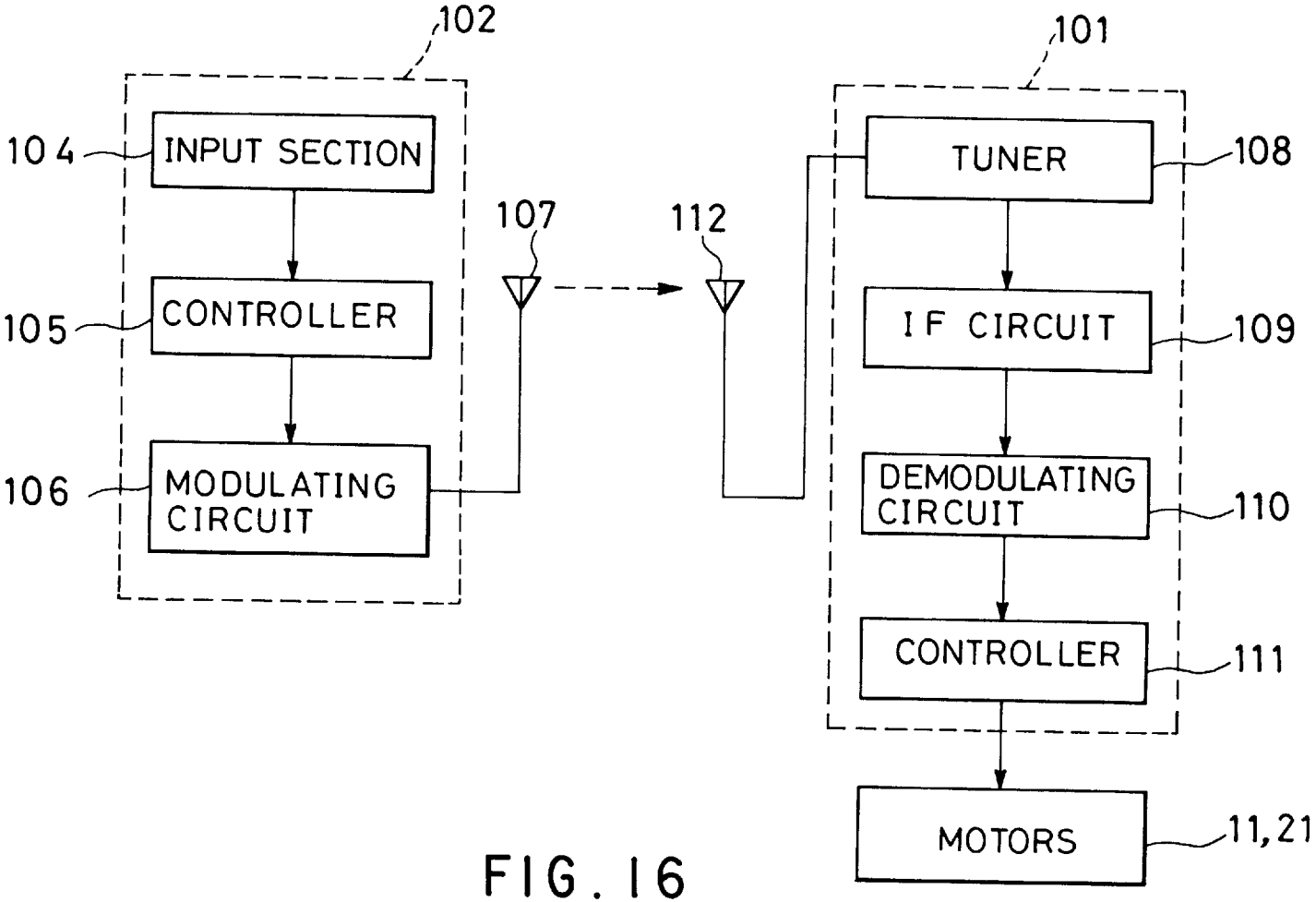
FIG. 16 is a conceptual diagram showing the structures of the control box and control device used in FIG. 15.

As shown in FIG. 16, the control box 102 has an input section 104 including the joysticks 103A and 103B, a control section 105 and a modulating circuit 106. The input section 104 detects the directions in which the joysticks 103A and 103B are tilted and the tilt angles of those joysticks, and outputs a detection signal. In this case, the joystick 103B has priority over the joystick 103A and when both of the joysticks 103A and 103B are operated (tilted) simultaneously, the input section outputs a detection signal associated with the joystick 103B.

The control section 105 discriminates instructions from an operator as to the forward traveling, the backward traveling, the leftward traveling, the rightward traveling, halt and the traveling speed, etc., and converts an operator's instruction to the corresponding control signal. The demodulating circuit 106 demodulates that control signal, and sends out the demodulated signal as radio waves.

The control device 101 in the body 1 has a tuner 108, an IF circuit (intermediate frequency circuit) 109, an AF demodulating circuit 110 and a controller 111. The tuner 108 tunes the radio waves of a specific frequency which have been received by an antenna 112 attached to the body 1. The IF circuit 109 converts a signal output from the tuner 108 to an intermediate frequency signal, and supplies it to the AF demodulating circuit 110. The AF demodulating circuit 110 demodulates the control signal generated by the controller 105 from the intermediate frequency signal, and outputs the demodulated control signal to the controller 111. The controller 111 drives the motors 11 and 21 in accordance with the demodulated control signal (the signal designating the traveling direction and the traveling speed), moving the body 1 in the designated direction and at the designated speed.

For example, the controller 111 supplies a driving current for a rotation in the normal (forward) direction or that for a rotation in the reverse direction to the rear-wheels driving motor 11 through a driver and/or the like in response to the control signal designating the forward/backward traveling and its speed.

Moreover, the controller 111 supplies a driving current for a rotation in the normal direction or that for a rotation in the reverse direction through a driver and/or the like to the rightward/leftward travel wheels driving motor 21 in response to the control signal designating the rightward/leftward traveling and its speed.

The actuation of the toy car according to the first embodiment will now be described.

(1) Forward Traveling

The joystick 103A on the control box 102 is tilted in the F direction. The input section 104 detects this operation, and sends an operation signal to the controller 105. Based on the operation signal, the controller 100 generates a control signal for rotating the motor 11 in the normal (forward) direction at the speed according to the tilt angle of the joystick 103A, and supplies the control signal to the modulating circuit 106. The modulating circuit 106 modulates the control signal, and sends out the modulated signal from the antenna 107.

The antenna 112 receives the transmitted radio waves, the tuner 108 tunes those radio waves, and the IF circuit 109 converts the output signal to the intermediate frequency signal and supplies the intermediate frequency signal to the AF demodulating circuit 110 in order to demodulate the control signal.

The controller 111 outputs, to the rear-wheels driving motor 11, a driving signal (electric power) having the voltage value corresponding to the speed designated by the control signal and a polarity for a rotation in the normal (forward) direction.

The rear-wheels driving motor 11 rotates in the normal direction at the speed corresponding to the tilt angle of the joystick 103A, and rotates the rear wheels 3 in the normal direction with the gears 12, 14, 15 and the axle 3*a* of the rear-wheels driving device 10. When the wheel support members 7 are in the lighting-up positions as shown in FIGS. 1, 3 and 7, the front wheels 2 and the rear wheels 3 are in contact with the ground. Consequently, the body 1 travels forward in accordance with the rotation of the rear wheels 3 in the normal direction.

Due to the rotation of the motor 11 in the normal direction, the driving transformation gear 16 is rotated in the direction of the arrow Y1 by the gears 12, 14 and the rotary shaft 13, as shown in FIG. 10. In consequence, the planetary gear 35 is rotated in the Y1 direction around the driving transformation gear 16 by the arm 35*a*, and engages with the intermediate gear 37. Thus, the rotation of the motor 11 in the normal direction is transmitted to the driven gear 36 through the driving transformation gear 16, the planetary gear 35 and the intermediate gear 37, rotating the driven gear 36 in the direction opposite to the rotary direction of the driving transformation gear 16.

The rotation of the driven gear 36 is transmitted by the rotation transmission mechanism 38 (FIG. 9) to the rotation transmission gear 44. When the wheel support members 7 are in the lifting-up positions, the pinion 45 which is in mesh with the rotation transmission gear 44 is out of mesh with the tooth portion 56*b* on the sector rack 56 of one wheel support member 7, as shown in FIG. 13. Therefore, the pinion 45 rotates idly, the wheel support members 7 remain in the lifting-up positions, and the rightward/leftward travel wheels 8 remain in higher positions than the front wheels 2 and the rear wheels 3. Consequently, the front wheels 2 and the rear wheels 3 keep contacting the ground.

Next, let it be considered the case where a forward traveling instruction is given while the wheel support members 7 are being kept in the lifting-down positions as shown in FIGS. 2, 4, 8 and 14.

Under the above condition also, the rear wheels 3 are rotated by the rear-wheels driving device 10 and the axle 3*a* upon the rotation of the rear-wheels driving motor 11 in the normal direction.

Moreover, under the above-described condition, the pinion 45 is in mesh with the tooth portion 56*b* on the sector rack 56 of the wheel support member 7 for the left wheels. Hence, upon the rotation of the pinion 45, the sector rack 56 is rotated in the direction of the arrow Y3. This rotation causes the clockwise rotation of the wheel support member 7 for the left wheels on one support shaft 6. Since the sector gears 57 and 58 are in mesh with each other, the wheel support member 7 for the right wheels rotates counterclockwise on the other support shaft 6. Finally, the pinion 45 disengages from the tooth portion 56*b*, and becomes the state shown in FIG. 13 due to the presence of the coil spring 59. As a result, the rightward/leftward travel wheels 8 come to higher positions shown in FIG. 13 than the front wheels 2 and the rear wheels 3. Accordingly, the front wheels 2 and the rear wheels 3 ground with the rear wheels 3 rotating, and the toy car travels forward at the desired speed.

(2) Backward Traveling

The joystick 103A on the control box 102 is tilted in the B direction. The input section 104 detects this operation, and sends an operation signal to the controller 105. Based on the operation signal, the controller 105 generates a control signal for rotating the motor 11 in the reverse direction at the speed according to the tilt angle of the joystick 103A, and supplies the control signal to the modulating circuit 106. The modulating circuit 106 modulates the control signal, and transmits the modulated signal from the antenna 107.

The antenna 112 receives the transmitted radio waves, the tuner 108 tunes those radio waves, and the IF circuit 109 coverts the output signal to the intermediate frequency signal and supplies it to the AF demodulating circuit 110 in order to reproduce the control signal.

The controller 111 outputs, to the rear-wheels driving motor 11, a driving signal having the voltage value corresponding to the speed designated by the control signal and a polarity for a rotation in the reverse direction, and the rear-wheels driving motor 11 rotates in the reverse direction.

The rotation of the rear-wheels driving motor 11 in the reverse direction is transmitted to the rear wheels 3 through the rear-wheels driving device 10 and the axle 3*a* such that the rear wheels 3 rotate in the reverse direction.

Upon the rotation of the motor 11, the driving transformation gear 16 is rotated in the direction of the arrow X1 shown in FIG. 10. The planetary gear 35 is rotated to the right on the rotary shaft 13 by the arm 35*a*, and engages with the driven gear 36. Consequently, the driven gear 36 rotates in the same direction as that in the case where the rear-wheels driving motor 11 rotates in the normal direction.

The rotation of the driven gear 36 is transmitted by the rotation transmission mechanism 38 (FIG. 9) to the rotation transmission gear 44. When the wheel support members 7 are in the lifting-up positions, the pinion 45 which is in mesh with the rotation transmission gear 44 is out of mesh with the tooth portion 56*b* on the sector rack 56 of one wheel support member 7. Therefore, the pinion 45 rotates idly, the wheel support members 7 remain in the lifting-up positions, and the rightward/leftward travel wheels 8 remain in higher positions than the front wheels 2 and the rear wheels 3. Consequently, the front wheels 2 and the rear wheels 3 keep contacting the ground without the rightward/leftward travel wheels 8 grounding, and the body 1 travels backward.

Even under the condition wherein the wheel support members 7 are in the lifting-down positions, the rotation of the rear-wheels driving motor 11 in the reverse direction is transmitted to the rear wheels 3, rotating those wheels 3 in the reverse direction.

Further, the pinion 45 engaging with the rotation transmission gear 44, which rotates in accordance with the rotation of the driven gear 36, is in mesh with the teeth portion 56*b* on the sector rack 56 of one wheel support member 7. Owing to this, upon the rotation of the pinion 45, the sector rack 56 is rotated in the direction of the arrow Y3. This causes the upward rotation of the wheel support members 7. When the wheel support members 7 come to the lifting-up positions, the pinion 45 disengages from the tooth portion 56*b*, and the coil spring 59 keeps the wheel support members 7 in the lifting-up positions. Therefore, the front wheels 2 and the rear wheels 3 ground with the rear wheel 3 rotating in the reverse direction, and the toy car travels backward at the desired speed.

(3) Rightward Traveling

The direction of that rotation of the rightward/leftward travel wheels driving motor 21 which causes the toy car to travel rightward, and the direction of that rotation of the motor 21 which causes the toy car to travel leftward, will be hereinafter referred to as the normal rotational direction and the reverse rotational direction, respectively.

The joystick 103B on the control box 102 is tilted in the R direction. The input section 104 detects this operation, and sends an operation signal to the control section 105. In this case, the input section 104 detects the operation of the joystick 103B by priority over the operation of the joystick 103A, and outputs an operation signal associated with the joystick 103B when the joysticks 103A and 103B are operated simultaneously.

The control section 105 generates a control signal for rotating the motor 21 in the normal direction at the speed according to the tilt angle of the joystick 103B, and supplies the control signal to the modulating circuit 106. The modulating circuit 106 modulates the control signal and transmits the modulated signal from the antenna 107.

The antenna 112 receives the transmitted radio waves, the tuner 108 tunes those radio waves, and the IF circuit 109 converts the output signal to the intermediate frequency signal and supplies it to the AF demodulating circuit 110 in order to demodulate the control signal.

The controller 111 outputs a normal rotation signal to the motor 21 in response to the control signal. In response to this normal rotation signal, the motor 21 rotates in the normal direction and causes the driving gear 22, intermediate gear 24, transmission gears 25, intermediate gears 26, 27 and driven gears 28 of the rightward/leftward travel wheels driving device 20 to rotate the right/left travel wheels 8 in the normal direction (FIGS. 6 and 7).

As the intermediate gear 24 rotates in the direction of the arrow Y2 showing the normal rotational direction, the planetary gear 46 rotates around the rotary shaft 23 together with the arm 46*a* in the direction of the arrow Y2, and meshes with the intermediate gear 48, as shown in FIG. 11. Upon the rotation of the motor 21, the driven gear 47 is rotated by the intermediate gear 24, the driving transformation gear 29, the planetary gear 46 and the intermediate gear 48 in the direction opposite to that of the arrow Y2, i.e., in the same direction as that of the arrow X2.

As shown in FIG. 9, the rotation of the driven gear 47 is transmitted to the second driven gear 53 through the first transmission gear 50 and intermediate gears 51 and 52 of the traveling direction changeover transformation mechanism 49 such that the pinion 54 which is in mesh with the gear 47 (FIGS. 12 and 13) is rotated.

As shown in FIG. 13, when the wheel support members 7 are in the lifting-up positions, the pinion 54 is in mesh with the tooth portion 56*a* of the sector rack 56. This results in the sector rack 56 being rotated in the direction of the arrow X3, rotating the wheel support member 7 for the left wheels counterclockwise. Upon this rotation, the support member 7 for the right wheels is rotated clockwise by the sector gears 57 and 58 which are in mesh with each other. Finally, the pinion 54 disengages from the tooth portion 56*a*, the wheel support members 7 come to the lifting-down positions shown in FIG. 14 and maintain those positions with the wheel support members 7 being biased by the coil spring 59, as shown in FIG. 8.

Therefore, the right/left travel wheels 8 come down with rotating in the normal direction, and the toy car travels rightward upon grounding of the right/left travel wheels 8.

In the case where the wheel support members 7 are in the lifting-down positions shown in FIG. 14 from the beginning, the pinion 54 is out of mesh with the tooth portion 56*a* and rotates idly, and the wheel support members 7 remain in the lifting-down positions. Consequently, the toy car travels rightward without entailing the lifting-up and lifting-down actions of the wheel support members 7.

(4) Leftward Traveling

When the joystick 103B on the control box 102 is tilted in the L direction, the controller 111 outputs a reverse rotation signal to the motor 21. The motor 21 reverses, rotating the rightward/leftward travel wheels 8 in the reverse direction. Moreover, as shown in FIG. 11, the driving transformation gear 29 causes the arm 46*a* to rotate the planetary gear 46 around the rotary shaft 23 in the direction of the arrow X2 such that the planetary gear 46 engages with the driven gear 47. Consequently, the rotation of the intermediate gear 24 is transmitted to the driven gear 47 through the gears 29 and 46, and the driven gear 47 is rotated in the same direction as that in the case of rotating the motor 21 in the normal direction. The other operations are the same as those in the case of rotating the motor 21 in the normal direction, and the toy car travels leftward.

The forward/backward traveling speed and the rightward/leftward traveling speed are determined by the tilt angle of the joystick 103B.

(5) Halt

The joysticks 103A and 103B on the control box 102 are made to stand upright as shown in FIG. 15. The controller 105 of the control device 101 outputs a control signal for stopping the supply of a current to the motors 11 and 21. Due to this, the control section 111 stops the supply of electric power to the motors 11 and 21, and the toy car halts.

According to the toy car of the first embodiment, as described above, switching between the forward, backward, rightward and leftward traveling directions can be rapidly performed without changing the orientation (direction) of the body.

Second Embodiment

A second embodiment of the toy car according to the present invention will now be described with reference to FIGS. 17 to 20.

In this embodiment, the right and left wheels 3 are rotatable separately from each other, the rear-wheels driving device has a transmission mechanism for driving two rear wheels independently from each other, and a body turning mechanism is arranged, in which points this embodiment differs from the first embodiment, but is identical with the first embodiment in the other points. In this embodiment, therefore, the first transformation mechanism, the rotation transmission mechanism, the changeover device, the second transformation mechanism and the traveling direction changeover transmission mechanism, shown in FIGS. 1 to 4, FIG. 6, FIG. 11, FIGS. 12 to 14 and FIG. 9, are used as they are.

Figure 17:
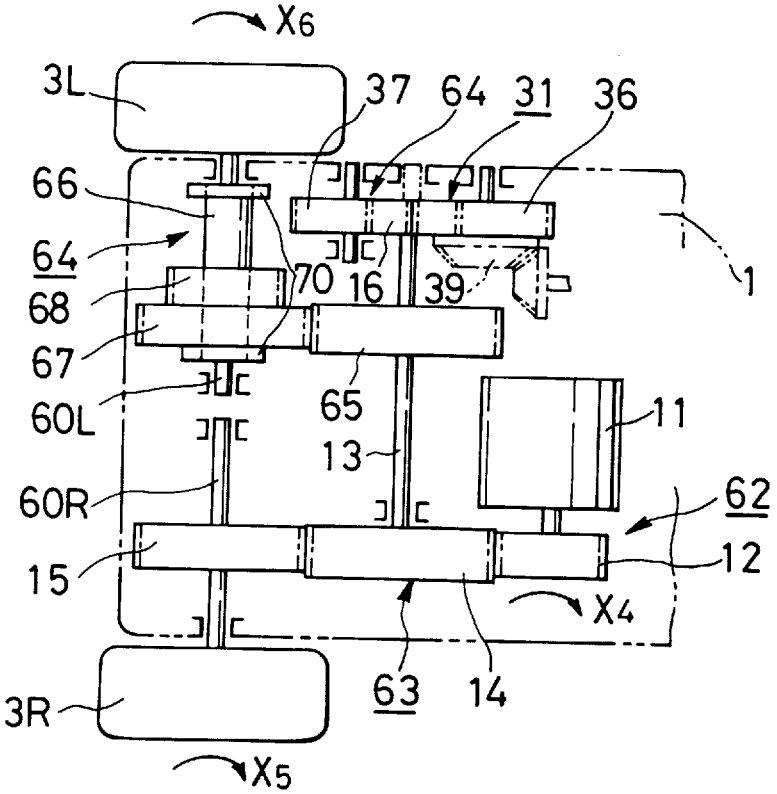
FIG. 17 is a diagram showing a schematic plan view of a front- and rear-wheels driving mechanism and that of a body turning device according to a second embodiment of the toy car of the present invention in the case of performing normal forward and backward traveling operations.
Figure 18:
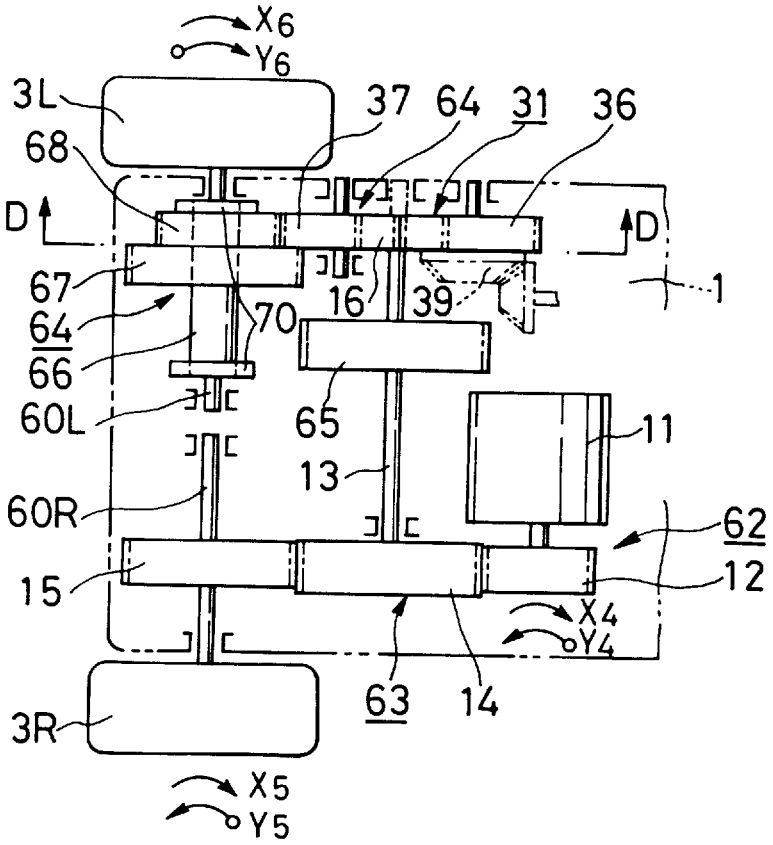
FIG. 18 is a diagram showing a schematic plan view of the front and rear-wheels driving mechanism and that of the body turning device according to the second embodiment of the toy car of the present invention in the case of performing the forward traveling operation and a car body turning operation.

As shown in FIGS. 17 and 18, a rear-wheels driving device 62 has a rear-wheels driving motor 11 and a transmission mechanism 63 which are fixed to the body 1.

As in the case of the first embodiment, the transmission mechanism 63 includes a driving gear 12, an intermediate gear 14 and a driven gear 15 which are sequentially in mesh with one another, and an intermediate gear 65 and a driven gear 67 which are in mesh with each other. The driving gear 12 is fixed to an output shaft of the rear-wheels driving motor 11 fixed to the body 1. The intermediate gear 14 is fixed to one end of a rotary shaft 13 which is rotatably supported by the body 1. The driven gear 15 is fixed to an axle 60R provided only for the right rear wheel. The intermediate gear 65 is fixed to the left rear-wheel side of the rotary shaft 13. The driven gear 67 is arranged at a spline guide portion 66 formed on an axle 60L provided only for the left rear wheel so that the driven gear 67 is slidable in an axial direction of the spline guide portion 66.

The rotation of the rear-wheels driving motor 11 in the normal/reverse direction is transmitted to the right rear wheel 3R through the transmission mechanism 63 such that the right rear wheel 3R rotates in the normal/reverse direction. An illustrated arrow X4 shows the normal rotational direction of the rear-wheels driving motor 11, while arrows X5 and X6 show the normal rotational direction of the right rear wheel 3R and that of the left rear wheel 3L, respectively.

As shown in FIG. 17, when the driven gear 67 is in mesh with the intermediate gear 65, the rotation of the rear-wheels driving motor 11 in the normal/reverse direction is transmitted to the axle 60L of the left rear wheel 3L through the gears 12, 14, the rotary shaft 13 and the gears 65, 67 such that the left rear wheel 3L rotates in the normal/reverse direction. Therefore, under the conditions shown in FIG. 17, the left and right wheels 3L and 3R are rotated at the same speed by the rear-wheels driving motor 11, and the toy car travels forward or backward.

Figure 19:
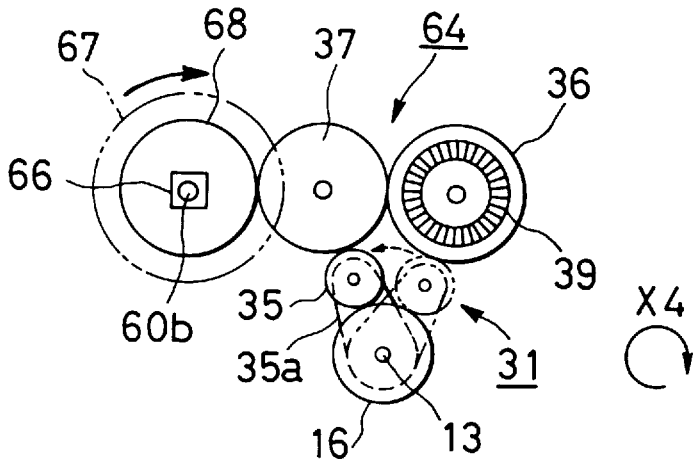
FIG. 19 is a front view of the second embodiment of the toy car according to the present invention while the toy car is traveling forward in accordance with the rotational speed of a rear-wheels driving motor.
Figure 20:
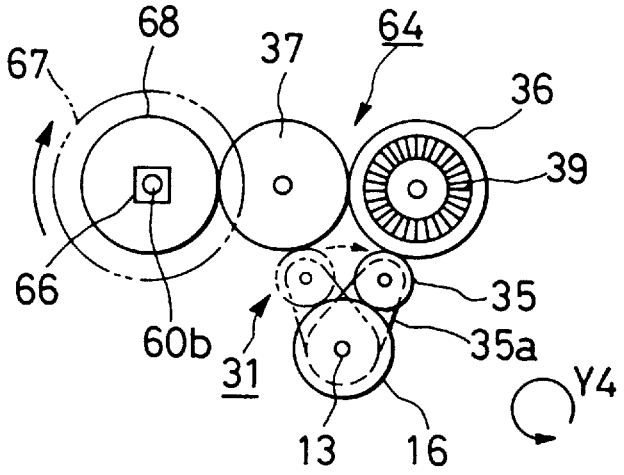
FIG. 20 is a front view of the second embodiment of the toy car according to the present invention while the body of the toy car is taking a turn in accordance with the rotational direction of the rear-wheels driving motor.

As shown in FIGS. 19 and 20, a turning mechanism 64 includes a first transformation mechanism 31 such as that of the first embodiment, and a body turning gear 68. The body turning gear 68 is formed integrally on that surface, which faces the right rear wheel 3L, of the driven gear 67 located on the left hand of the transmission mechanism 63.

Explanations will now be made as regards the actuation of the turning mechanism 64 when the rear-wheels driving motor 11 rotates in the normal direction and the actuation of the mechanism 64 when the motor 11 rotates in the reverse direction under the condition wherein the body turning gear 68 is in mesh with the intermediate gear 37 of the first transformation mechanism 31, as shown in FIG. 18.

When the rear-wheels driving motor 11 rotates in the normal direction represented by the arrow X4 illustrated in FIG. 18, the right rear wheel 3R rotates in the normal direction of the arrow X5.

Further, as shown in FIG. 19, the planetary gear 35 rotates counterclockwise around the rotary shaft 13 from the position shown by a broken line, and meshes with the intermediate gear 37. Owing to this, the rotation of the rear-wheels driving motor 11 is transmitted to the body turning gear 68 through the driving gear 16 and intermediate gear 37 of the first transformation mechanism 31, rotating the left rear wheel 3L in the normal direction represented by the arrow X6. Accordingly, the toy car travels forward.

When the rear-wheels driving motor 11 rotates in the reverse direction represented by an arrow Y4 in FIG. 18, the right rear wheel 3R rotates in the direction (reverse direction) of an arrow Y5.

Meanwhile, the planetary gear 35 of the first transformation mechanism 31 rotates clockwise around the rotary shaft 13 from the position shown by a broken line in FIG. 20, and meshes with the driven gear 36. The driving gear 16 rotates in the direction opposite to that in the case of FIG. 19, and this rotation is transmitted to the driven gear 67 through the planetary gear 35, the driven gear 36 and the intermediate gear 37, rotating the left rear wheel 3L in the direction of an arrow Y6 in FIG. 18. The direction of the arrow Y6 is identical with that of the arrow X6, and the left rear wheel 3L rotates in the normal direction.

The left rear wheel 3L rotates in the normal direction, while the right rear wheel 3R rotates in the reverse direction, due to which the toy car turns, changing its direction rapidly.

In the vicinity of the axle 60L of the left rear wheel 3L, an electromagnetic changeover device (actuator) 70 is fixed to the body 1.

The electromagnetic changeover device 70 slides the intermediate gear 67 and the turning gear 68 along the spline guide 66, thus performing a changeover between the condition wherein the turning gear 68 is in mesh with the intermediate gear 16 as shown in FIG. 17 and the condition wherein the driven gear 67 is in mesh with the intermediate gear 65 as shown in FIG. 18.

It is possible also in the second embodiment to operate the toy car with the radio device shown in FIGS. 15 and 16. In this case, the input section 104 of the control box 102 has a switch for giving (inputting) an instruction to turn the body 1.

The operation of the second embodiment will now be described.

(1) The state wherein the turning button 113 is not being operated

When the control box 102 orders the forward or backward traveling, the controller 111 causes the motor 11 to rotate in the normal or reverse direction.

The rotation of the rear-wheels driving motor 11 in the normal direction is transmitted to the axle 60R through the gears 12,14 and 15, and the right rear wheel 3R rotates in the normal or reverse direction.

The driven gear 67 is normally in mesh with the intermediate gear 65 as shown in FIG. 17. Consequently, the rotation of the rear-wheels driving motor 11 in the normal or reverse direction is transmitted to the axle 60L of the left rear wheel 3L through the gears 12,14, the rotary shaft 13, and the gears 65 and 67, and the left rear wheel 3 rotates in the normal or reverse direction. Therefore, the left and right rear wheels 3L and 3R rotate in the same direction at the same speed, and the toy car travels forward or backward.

(2) The state wherein the turning button 113 is being operated

When the turning button 113 on the control box 102 is depressed, the input section 104 detects that operation. The input section 104 supplies, to the controller 105, a turning button operation signal indicating that the turning button 113 is being depressed. The controller 111 outputs an excitation signal to excite the electromagnetic changeover device 70, together with a normal control signal for the forward or backward traveling. The control signal and the excitation changeover device 70 are demodulated by the modulating circuit 106, and are send out from the antenna 107.

The radio waves send out from the antenna 107 are received by the tuner 108 through the antenna 112, and are converted to the IF signal by the IF circuit 109. The AF modulating circuit performs the demodulation, and supplies the resultant signal to the controller 111.

The controller 111 supplies a driving signal to the motors 11 and 21 in accordance with the control signal, and also supplies an excitation current to the solenoid of the electromagnetic changeover device 70 in accordance with the demodulated excitation signal. The electromagnetic changeover device 70 is driven by the excitation current, and slides the intermediate gear 67 and the turning gear 68 from the position shown in FIG. 17 to that shown in FIG. 18. As a result, the gears 65 and 67 disengage from each other, and the intermediate gear 37 and the turning gear 68 mesh with each other.

When the turning button 113 on the control box 102 is released, the input section 104 stops outputting the turning button operation signal. Accordingly, the controller 111 ceases the supply of the excitation current to the electromagnetic changeover device 70. Then, the electromagnetic changeover device 70 becomes OFF and slides the intermediate gear 67 and the turning gear 68 from the position shown in FIG. 18 to the home position shown in FIG. 17. In consequence, the intermediate gear 37 and the turning gear 68 disengage from each other, and the gears 65 and 67 mesh with each other, thus returning to the normal condition.

(i) Forward Traveling

When the controller 111 causes the rear-wheels driving motor 11 to rotate in the normal direction under the condition wherein the turning button 112 on the control box 102 is being depressed (i.e. the condition wherein the intermediate gear 37 and the turning gear 68 are in mesh with each other), the planetary gear 35 rotates counterclockwise around the rotary gear 13 and meshes with the intermediate gear 37 as shown in FIG. 19. Owing to this, the rotation of the rear-wheels driving motor 11 in the normal direction is transmitted to the turning gear 68 through the intermediate gear 37, and the left rear wheel 3L rotates in the normal direction represented by the arrow X6. Accordingly, the toy car travels forward.

(3) The state wherein the turning button 113 is being operated: a turn

When the controller 111 causes the rear-wheels driving motor 11 to rotate in the reverse direction under the condition wherein the turning button 113 on the control box 102 is being depressed (i.e. the condition wherein the intermediate gear 37 and the turning gear 68 are in mesh with each other), the planetary gear 35 rotates clockwise around the rotary shaft 13 and meshes with the driven gear 36 as shown in FIG. 20. Due to this, the rotation of the rear-wheels driving motor 11 in the reverse direction is transmitted to the turning gear 68 through the gears 36 and 37, and the left rear wheel 3L rotates in the normal direction.

Meanwhile, the right rear wheel 3R rotates in the reverse direction upon the rotation of the motor 11 in the reverse direction, Thus, the rotational direction of the right rear wheel 3R and that of the left rear wheel 3L differ from each other. Consequently, the body 1 rapidly changes its orientation clockwise (the body 1 turns clockwise).

According to this embodiment, as described above, the orientation (direction) of the body can be rapidly changed without steering the wheels. Moreover, as in the case of the first embodiment, the front and backward traveling on the front and rear wheels 2 and 3 and the rightward and leftward traveling on the right and left wheels 8 are possible as well.

The electromagnetic changeover device 70 may not be excited while the turning button 113 is being depressed, and a changeover between the excitation and non-excitation may be performed each time the turning button 113 is depressed.

Moreover, not only the electromagnetic changeover device 70, but also another arbitrary structure by which the intermediate gears 67 and the turning gears 68 can be switched from one position to another can be employed.

Third Embodiment

A third embodiment of the toy car according to the present invention will now be described with reference to FIG. 21.

The basic structure of the toy car of this embodiment is identical with that of the second embodiment. However, the third embodiment differs from the second embodiment in that a plurality of motors are used to drive the rear wheels.

Figure 21:
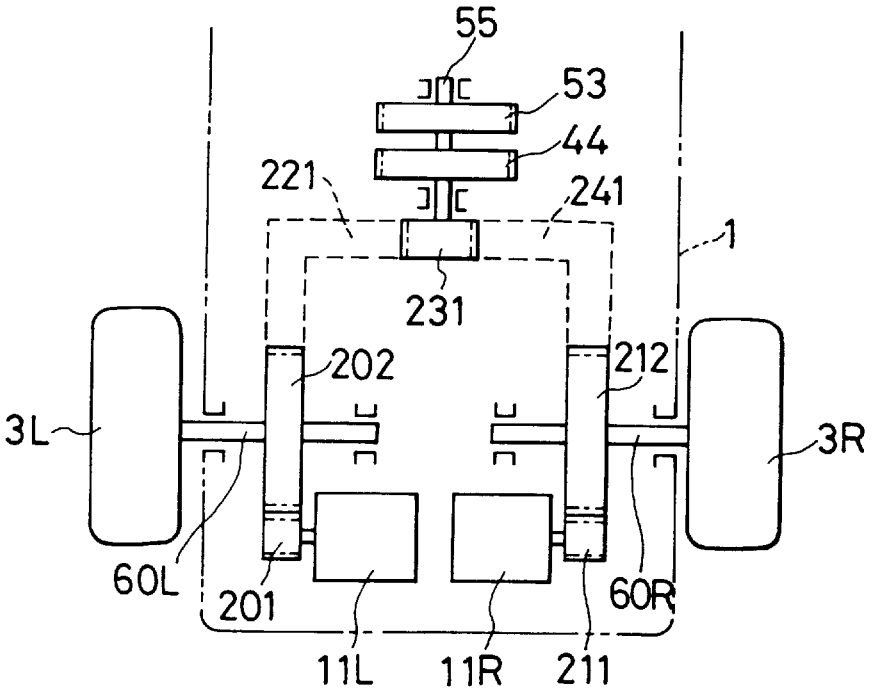
FIG. 21 is a diagram showing the structure of a section for driving the rear wheels and that of a section for driving support members in a toy car according to third and fourth embodiments of the present invention.

The toy car of this embodiment has a left rear-wheel driving motor 11 L and a right rear-wheel driving motor 11 R which are fixed to the body 1, as shown in FIG. 21

The rotation of the left rear-wheel driving motor 11L is transmitted to the left rear wheel 3L through gears 201, 202 and an axle 60L.

Further, the rotation of the right rear-wheel driving motor 11R is transmitted to the left rear wheel 3R through gears 211, 212 and an axle 60R.

The rotation of the left rear-wheel driving motor 11L is transmitted through a gear train 221 to a gear 231 fixed to a rotary shaft (here, the rotary shaft 55 as in the cases of the first and second embodiments) for driving the wheel support members 7.

On the other hand, the rotation of the right rear-wheel driving motor 11R is transmitted to the rotary shaft 55 through a rotary direction transformation mechanism 241 having structures similar to those shown in FIGS. 10 and 11. As shown in FIGS. 12 to 14, the gears 44 and 53 are fixed to the rotary shaft 55. As shown in FIG. 13, the second transmission gear 53 meshes with the tooth portion 56*a* of the sector rack 56 with the pinion 54 therebetween. Further, as shown in FIG. 13, the gear 44 meshes with the tooth portion 56*b* of the sector rack 56 with the pinion 45 therebetween.

The other structures are substantially the same as those of the second embodiment.

The actuation of the toy car according to the third embodiment will now be described.

(1) Forward Traveling

The joystick 103A on the control box 102 is tilted in the F direction. The input section 104 detects this operation, and sends an operation signal to the controller 105. Based on the operation signal, the controller 105 generates a control signal for rotating the motors 11L and 11R in the normal direction at the speed according to the tilt angle of the joystick 103A, and supplies the control signal to the modulating circuit 106. The modulating circuit 106 modulates the control signal, and sends out the modulated signal from the antenna 107.

The antenna 112 receives the transmitted radio waves, the tuner 108 tunes those radio waves, and the IF circuit 109 converts the output signal to the intermediate frequency signal and supplies it to the AF demodulating circuit 110 in order to reproduce the control signal.

The controller 111 outputs, to the rear-wheel driving motors 11L and 11R, a driving signal (electric power) having the voltage value corresponding to the speed designated by the control signal and a polarity for a rotation in the normal direction.

The rear-wheel driving motors 11L and 11R rotate in the normal direction at the speed corresponding to the tilt angle of the joystick 103A, and rotates the rear wheels 3L and 3R in the normal direction with the gears 201, 202, 211, 212 and the axles 60L and 60R.

When the wheel support members 7 are in the lifting-up positions, the front wheels 2 and the rear wheels 3 are in contact with the ground. Accordingly, the body 1 travels forward.

Meanwhile, upon the rotation of the motor 11L in the normal direction, the rotary shaft 55 is rotated in the normal direction by trains of gears 201, 202, 221 and 231. Furthermore, upon the rotation of the motor 11R in the normal rotation, the rotary shaft 55 is rotated in the normal direction by the gear 211 and 212, the rotary direction transformation mechanism 241 and the gear 231. In short, both of the motors 11L and 11R rotate the rotary shaft 55 in the normal direction.

When the wheel support members 7 are in the lifting-up positions, the pinion 45 which is in mesh with the rotation transmission gear 44 is out of mesh with the tooth portion 56*b* on the sector rack 56 of one wheel support member 7, as shown in FIG. 13. Therefore, the pinion 45 rotates idly, the wheel support members 7 remain in the lifting-up positions, and the rightward/leftward travel wheels 8 remain in higher positions than the front wheels 2 and the rear wheels 3. Consequently, the front wheels 2 and the rear wheels 3 keep contacting the ground.

In contrast, when the wheel support members 7 are in the lifting-down positions, the pinion 45 is in mesh with the tooth portion 56*b* on the sector rack 56 of the wheel support member 7 for the left wheels, as shown in FIG. 14. Owing to this, upon the rotation of the pinion 45, the sector rack 56 is rotated in the direction of the arrow Y3. This rotation causes the clockwise rotation of the wheel support member 7 for the left wheels on one support shaft 6. Since the sector gears 57 and 58 are in mesh with each other, the wheel support member 7 for the right wheels rotates counterclockwise on the other support shaft 6. Finally, the pinion 45 disengages from the tooth portion 56*b* and becomes the state shown in FIG. 13 due to the coil spring 59. As a result, the rightward/leftward travel wheels 8 come up to higher positions shown in FIG. 13 than the front wheels 2 and the rear wheels 3. Consequently, the front wheels 2 and the rear wheels 3 ground with the rear wheels 3 rotating, and the toy car travels forward.

(2) Turning

The joystick 103A on the control box 102 is tilted in the B direction. The input section 104 detects this operation, and sends an operation signal to the controller 105. Based on the operation signal, the controller 105 generates a control signal for rotating the motor 11L in the normal direction and rotating the motor 11R in the reverse direction, and supplies the control signal to the modulating circuit 106. The modulating circuit 106 modulates the control signal, and sends the modulated signal from the antenna 107.

The antenna 112 receives the transmitted radio waves, the tuner 108 tunes those radio waves, and the IF circuit 109 converts the output signal to the intermediate frequency signal and supplies it to the AF demodulating circuit 110 in order to reproduce the control signal.

The controller 111 outputs a driving signal for rotating the rear-wheel driving motor 11L in the normal direction and rotating the rear-wheel driving motor 11R in the reverse direction.

In response to the drive signal, the rear-wheel driving motor 11L rotates in the normal direction and causes the gear 12 and the axle 3L to rear wheel 3L in the normal direction. Further, the rear-wheel driving motor 11R rotates in the reverse direction and causes the gear 145 and the axle 3R to rotate the rear wheel 3R in the reverse direction.

Meanwhile, upon the rotation of the motor 11L in the normal direction, the rotary shaft 55 is rotated in the normal direction by the trains of gears 201, 202, 221 and 231. Upon the rotation of the motor 11R in the normal rotation, the rotary shaft 55 is rotated by the gear 211 and 212, the rotary direction transformation mechanism 241 and the gear 231. In short, the motors 11L and 11R both rotate the rotary shaft 55 in the normal direction. When the wheel support members 7 are in the lifting-up positions, they maintain those positions. As shown in FIG. 13, the pinion 45 which is in mesh with the rotation transmission gear 44 is out of mesh with the tooth portion 56*b* on the sector rack 56 of one wheel support member 7. Therefore, the pinion 45 rotates idly, the wheel support members 7 remain in the lifting-up positions, and the rightward/leftward travel wheels 8 remain in higher positions than the front wheels 2 and the rear wheels 3. The body 1 starts turning.

On the other hand, under the condition wherein the wheel support members 7 are kept in the lifting-down positions, the wheel support members 7 are driven, the rear wheels 3L and 3R ground with rotating in opposite directions, and the toy car starts turning.

(3) Rightward Traveling, Leftward Traveling, Halt

These actions are the same as the rightward traveling, leftward traveling and halt of the toy cars of the first and second embodiments.

In case of the rightward traveling, for example, an operator tilts the joystick 103B of the control box 102 in the R direction. The input section 104 detects this operation, and sends an operation signal to the control section 105. In this case, the input section 104 detects the operation of the joystick 103B by priority over the operation of the joystick 103A, and outputs an operation signal associated with the joystick 103B when the joysticks 103A and 103B are operated simultaneously.

Based on the operation signal, the control section 105 generates a control signal for rotating the motor 21 in the normal direction at the speed according to the tilt angle of the joystick 103B, and supplies the control signal to the modulating circuit 106. The modulating circuit 106 modulates the control signal and sends out the modulated signal from the antenna 107.

The antenna 112 receives the transmitted radio waves, the tuner 108 tunes those radio waves, and the IF circuit 109 converts the output signal to the intermediate frequency signal and supplies it to the AF demodulating circuit 110 in order to demodulate the control signal.

The controller 111 outputs a normal rotation signal to the motor 21 in response to the control signal. In response to this normal rotation signal, the motor 21 rotates in the normal direction and causes the rightward/leftward travel wheels driving device 20 shown in FIGS. 6 and 7 to rotate the right/left travel wheels 8 in the normal direction.

As the intermediate gear 24 in the rightward/leftward travel wheels driving device 20 rotates in the direction of the arrow Y2, the planetary gear 46 rotates around the rotary shaft 23 in the direction of the arrow Y2 and meshes with the intermediate gear 48, as shown in FIG. 11. Due to this, upon the rotation of the motor 21, the driven gear 47 is rotated by the intermediate gear 24, the driving transformation gear 29, the planetary gear 46 and the intermediate gear 48 in the direction opposite to that of the arrow Y2, i.e., in the same direction as that of the arrow X2.

The rotation of the driven gear 47 in the X2 direction is transmitted to the second driven gear 53 through the traveling direction changeover transmission mechanism 49, rotating the pinion 54 which is in mesh with the gear 47 in the normal direction (FIGS. 12 to 14).

As shown in FIG. 13, when the wheel support members 7 are in the lifting-up positions, the pinion 54 is in mesh with the tooth portion 56*a* of the sector rack 56. Due to this, the sector rack 56 is rotated in the direction of the arrow X3, rotating the wheel support member 7 for the left wheels counterclockwise. Upon this rotation, the support member 7 for the right wheels is rotated clockwise by the sector gears 57 and 58 which are in mesh with each other. Finally, the pinion 54 disengages from the tooth portion 56*a*, the wheel support members 7 come to the lifting-down positions shown in FIG. 14 and keep those positions with the wheel support members 7 being biased by the coil spring 59, as shown in FIG. 8.

Therefore, the right/left travel wheels 8 come down with rotating in the normal direction, and the toy car travels rightward when the right/left travel wheels 8 ground.

In the case where the wheel support members 7 are in the lifting-down positions shown in FIG. 14 from the beginning, the pinion 54 is out of mesh with the tooth portion 56*a* and rotates idly, and the wheel support members 7 remain in the lifting-down positions. Consequently, the toy car travels rightward without causing the lifting-up or lifting-down actions of the wheel support members 7.

According to the structure of the third embodiment, the toy car can be moved using three motors. Moreover, switching between the forward traveling and the rightward/leftward traveling can be instantly performed. It is also possible to change the orientation (direction) of the body by turning the body.

Fourth Embodiment

In the third embodiment, a toy car which is capable of traveling forward, turning, and traveling rightward and leftward has been described. However, the actions are not limited to the above, and other actions can be added as desired.

Figure 22:
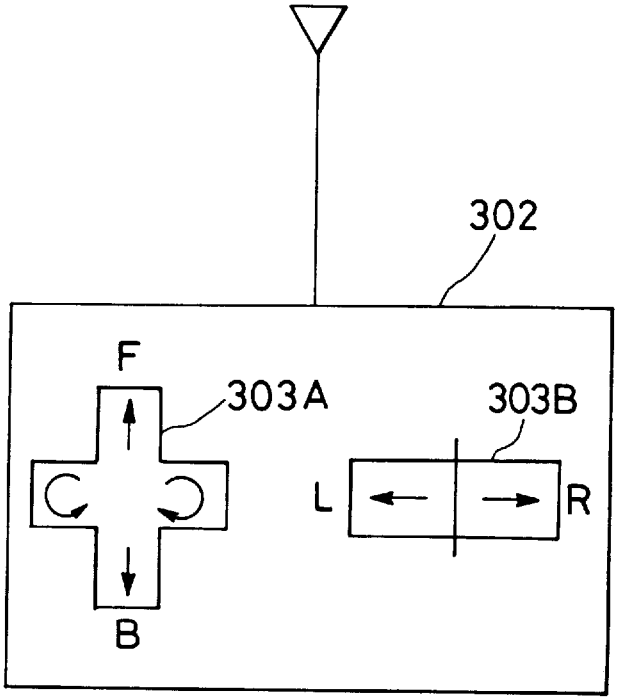
FIG. 22 is a front view of the control box according to the fourth embodiment of the present invention.

Thus, in a fourth embodiment, a toy car which is capable of traveling forward and backward, turning clockwise and counterclockwise and traveling rightward and leftward will be described with reference to FIG. 22.

A control box 302-of this embodiment has a cross button 303A and a rightward/leftward travel button 303B. Its circuit configuration is, however, substantially the same as that shown in FIG. 16.

The structure of the main body of the toy car is basically the same as that of the third embodiment. However, the gear train 221 in FIG. 21 is formed of a rotation transformation mechanism for transforming the rotation of the motor 11L to a rotation in one direction, irrespective of the rotational direction of the motor 11L. The rotation transformation mechanism 221 has structures such as those shown in FIGS. 18 and 19, for example.

The actuation of the toy car according to the fourth embodiment will now be described.

(1) Forward Traveling

The cross button 303A of n the control box 302 is tilted in the F direction. The input section 104 shown in FIG. 16 detects this operation, and sends an operation signal to the controller 105. Based on the operation signal, the controller 105 generates a control signal for rotating the motors 11L and 11R in the normal direction at the speed according to the tilt angle of the joystick 103A, and supplies the control signal to the modulating circuit 106. The modulating circuit 106 modulates the control signal, and sends the modulated signal from the antenna 107.

The antenna 112 receives the transmitted radio waves, the tuner 108 tunes those radio waves, and the IF circuit 109 converts the output signal to the intermediate frequency signal and supplies it to the AF demodulating circuit 110 in order to reproduce the control signal.

The controller 111 outputs, to the rear-wheel driving motors 11L and 11R, a driving signal (electric power) having the voltage value corresponding to the speed designated by the control signal and a polarity for a rotation in the normal direction.

The rear-wheel driving motors 11L and 11R rotate in the normal direction at the speed corresponding to the tilt angle of the cross button 303A, and causes the gears 201, 202, 211, 212 and the axles 60L, 60R to rotate the rear wheels 3L and 3R in the normal direction, as shown in FIG. 21.

When the wheel support members 7 are in the lifting-up positions, the front wheels 2 and the rear wheels 3 (3L, 3R) are in contact with the ground. Accordingly, the body 1 travels forward.

Meanwhile, the rotation of the motor 11L in the normal direction is transmitted to the rotational direction changeover mechanism 221 through the train of gears 201 and 202, causing the rotational direction changeover mechanism 221 to rotate the gear 231 fixed to the rotary shaft 55 in the normal direction. Further, the rotation of the motor 11R in the normal direction is transmitted to the rotational direction changeover mechanism 241 through the trains of gears 211 and 212, causing the rotational direction changeover mechanism 241 to rotate the gear 231 in the normal direction. In short, the motors 11L and 11R both rotate the rotary shaft 55 in the normal direction.

When the wheel support members 7 are in the lifting-up positions, the pinion 45 which is in mesh with the rotation transmission gear 44 fixed to the rotary shaft 55 is out of mesh with the tooth portion 56*b* on the sector rack 56 of one wheel support member 7, as shown in FIG. 13. Therefore, the pinion 45 rotates idly, the wheel support members 7 remain in the lifting-up positions, and the rightward/leftward travel wheels 8 remain in higher positions than the front wheels 2 and the rear wheels 3. Consequently, the front wheels 2 and the rear wheels 3 (3L, 3R) keep contacting the ground. The body 1 travels forward accordingly.

In contrast, when the wheel support members 7 are in the lifting-down positions, the pinion 45 is in mesh with the tooth portion 56*b* on the sector rack 56 of the wheel support member 7 for the left wheels, as shown in FIG. 14. Due to this, upon the rotation of the pinion 45, the sector rack 56 is rotated in the direction of the arrow Y3. This rotation results in the wheel support member 7 for the left wheels rotating clockwise on one support shaft 6. Since the sector gears 57 and 58 are in mesh with each other, the wheel support member 7 for the right wheels rotates counterclockwise on the other support shaft 6. Finally, the pinion 45 disengages from the tooth portion 56*b* and becomes the state shown in FIG. 13 due to the coil spring 59. As a result, the rightward/leftward travel wheels 8 come up to higher positions shown in FIG. 13 than the front wheels 2 and the rear wheels 3. Accordingly, the front wheels 2 and the rear wheels 3 ground with the rear wheels 3 rotating, and the toy car travels forward.

(2) Backward Traveling

The operator tilts the cross button 303A of the control box 302 in the B direction. The input section 104 sends an operation signal for the backward traveling to the controller 105. Based on the operation signal, the controller 105 generates a control signal for rotating the motors 11L and 11R in the reverse direction at the speed according to the tilt angle of the joystick 103A, and supplies the control signal to the modulating circuit 106. The modulating circuit 106 modulates the control signal, and sends out the modulated signal from the antenna 107.

The antenna 112 receives the transmitted radio waves, the tuner 108 tunes those radio waves, and the IF circuit 109 converts the output signal to the intermediate frequency signal and supplies it to the AF demodulating circuit 110 in order to reproduce the control signal.

The controller 111 outputs, to the rear-wheel driving motors 11L and 11R, a driving signal (electric power) having the voltage value corresponding to the speed designated by the control signal and a polarity for a rotation in the reverse direction.

The rear-wheel driving motors 11L and 11R rotate in the reverse direction at the speed corresponding to the tilt angle of the cross button 303A, and causes the gears 201, 202, 211, 212 and the axles 60L and 60R to rotate the rear wheels 3L and 3R in the reverse direction, as shown in FIG. 21.

When the wheel support members 7 are in the lifting-up positions, the front wheels 2 and the rear wheels 3 (3L, 3R) are in contact with the ground. The body 1 travels backward accordingly.

Meanwhile, the rotation of the motor 11L in the reverse direction is transmitted to the rotational direction changeover mechanism 221 through the train of gears 201 and 202. The rotational direction changeover mechanism 221 transforms the transmitted rotation in the reverse direction to a rotation in the normal direction, and rotates the gear 231 fixed to the rotary shaft 55 in the normal direction. Further, the rotation of the motor 11R in the reverse direction is transmitted to the rotational direction changeover mechanism 241 through the trains of gears 211 and 212. The rotational direction changeover mechanism 241 transforms the transmitted rotation in the reverse direction to a rotation in the normal direction, and rotates the gear 231 fixed to the rotary shaft 55 in the normal direction.

When the wheel support members 7 are in the lifting-up positions, the pinion 45 which is in mesh with the rotation transmission gear 44 fixed to the rotary shaft 55 is out of mesh with the tooth portion 56*b* on the sector rack 56 of one wheel support member 7, as shown in FIG. 13. Therefore, the pinion 45 rotates idly, the wheel support members 7 remain in the lifting-up positions, and the rightward/leftward travel wheels 8 remain in higher positions than the front wheels 2 and the rear wheels 3. Due to this, the front wheels 2 and the rear wheels 3 (3L, 3R) keep contacting the ground. The body 1 travels forward accordingly.

In contrast, when the wheel support members 7 are in the lifting-down positions, the pinion 45 is in mesh with the tooth portion 56*b* on the sector rack 56 of the wheel support member 7 for the left wheels, as shown in FIG. 14. Due to this, upon the rotation of the pinion 45, the sector rack 56 is rotated in the direction of the arrow Y3. This rotation causes the clockwise rotation of the wheel support member 7 for the left wheels on one support shaft 6. Since the sector gears 57 and 58 are in mesh with each other, the wheel support member 7 for the right wheels rotates counterclockwise on the other support shaft 6. Finally, the pinion 45 disengages from the tooth portion 56*b* and becomes the state shown in FIG. 13 due to the coil spring 59. As a result, the rightward/leftward travel wheels 8 come up to higher positions shown in FIG. 13 than the front wheels 2 and the rear wheels 3. The front wheels 2 and the rear wheels 3 ground with the rear wheels 3L and 3R rotating, and the toy car travels forward accordingly.

(3) Clockwise Turning

The joystick 103A of the control box 102 is tilted to the right. The input section 104 detects this operation, and sends an operation signal to the controller 105. Based on the operation signal, the controller 105 generates a control signal for rotating the motor 11L in the normal direction and rotating the motor 11R in the reverse direction, and supplies the control signal to the modulating circuit 106. The modulating circuit 106 modulates the control signal, and sends out the modulated signal from the antenna 107.

The antenna 112 receives the transmitted radio waves, the tuner 108 tunes those radio waves, and the IF circuit 109 converts the output signal to the intermediate frequency signal and supplies it to the AF demodulating circuit 110 in order to reproduce the control signal.

The controller 111 outputs a control signal for rotating the rear-wheel driving motor 11L in the normal direction and rotating the rear-wheel driving motor 11R in the reverse direction.

In response to the control signal, the rear-wheel driving motor 11L rotates in the normal direction and causes the gear 12 and the axle 3L to rotate the rear wheel 3L in the normal direction. The rear-wheel driving motor 11R rotates in the reverse direction and causes the gear 15 and the axle 60R to rotate the rear wheel 3R in the reverse direction.

The rotation of the motor 11L in the normal direction is transmitted to the rotational direction changeover mechanism 221 through the train of gears 201 and 202, causing the rotational direction changeover mechanism 221 to rotate the gear 231 fixed to the rotary shaft 55 in the normal direction. Further, the rotation of the motor 11R in the reverse direction is transmitted to the rotational direction changeover mechanism 241 through the trains of gears 211 and 212. The rotational direction changeover mechanism 241 transforms the transmitted rotation in the reverse direction to a rotation in the normal direction, and rotates the gear 231 in the normal direction.

When the wheel support members 7 are in the lifting-up positions, the pinion 45 which is in mesh with the rotation transmission gear 44 fixed to the rotary shaft 55 is out of mesh with the tooth portion 56*b* on the sector rack 56 of one wheel support member 7, as shown in FIG. 13. Therefore, the pinion 45 rotates idly, the wheel support members 7 remain in the lifting-up positions, and the rightward/leftward travel wheels 8 remain in higher positions than the front wheels 2 and the rear wheels 3. Due to this, the front wheels 2 and the rear wheels 3 (3L, 3R) keep contacting the ground. The right wheel 3L rotates in the normal direction, while the right wheel 3R rotates in the reverse direction, with the result that the body 1 turns clockwise.

In contrast, when the wheel support members 7 are in the lifting-down positions, the pinion 45 is in mesh with the tooth portion 56*b* on the sector rack 56 of the wheel support member 7 for the left wheels, as shown in FIG. 14. Due to this, upon the rotation of the pinion 45, the sector rack 56 is rotated in the direction of the arrow Y3. This rotation causes the clockwise rotation of the wheel support member 7 for the left wheels on one support shaft 6. Since the sector gears 57 and 58 are in mesh with each other, the wheel support member 7 for the right wheels rotates counterclockwise on the other support shaft 6. Finally, the pinion 45 disengages from the tooth portion 56*b* and becomes the state shown in FIG. 13 due to the coil spring 59. As a result, the rightward/leftward travel wheels 8 come up to higher positions shown in FIG. 13 than the front wheels 2 and the rear wheels 3. The front wheels 2 and the rear wheels 3 ground with the rear wheels 3L and 3R rotating, and the toy car turns clockwise.

(4) Counterclockwise Turning

The joystick 103A of the control box 102 is tilted to the left. The input section 104 detects this operation, and sends an operation signal to the controller 105. Based on the operation signal, the controller 105 generates a control signal for rotating the motor 11L in the reverse direction and rotating the motor 11R in the normal direction, and supplies the control signal to the modulating circuit 106. The modulating circuit 106 modulates the control signal, and transmits the modulated signal from the antenna 107.

The antenna 112 receives the transmitted radio waves, the tuner 108 tunes those radio waves, and the IF circuit 109 converts the output signal to the intermediate frequency signal and supplies it to the AF demodulating circuit 110 in order to reproduce the control signal.

The controller 111 outputs a control signal for rotating the rear-wheel driving motor 11L in the reverse direction and rotating the rear-wheel driving motor 11R in the normal direction.

In response to the control signal, the rear-wheel driving motor 11L rotates in the reverse direction and causes the gear 12 and the axle 3L to rotate the rear wheel 3L in the reverse direction. The rear-wheel driving motor 11R rotates in the normal direction and causes the gears 211, 212 and the axle 60R to rotate the rear wheel 3R in the normal direction.

Meanwhile, the rotation of the motor 11L in the reverse direction is transmitted to the rotational direction changeover mechanism 221 through the train of gears 201 and 202, and the rotational direction changeover mechanism 221 rotates the gear 231 in the normal direction. Further, the rotation of the motor 11R in the normal direction is transmitted to the rotational direction changeover mechanism 241 through the trains of gears 211 and 212, and the rotational direction changeover mechanism 241 rotates the gear 231 in the normal direction.

When the wheel support members 7 are in the lifting-up positions, the pinion 45 which is in mesh with the rotation transmission gear 44 fixed to the rotary shaft 55 is out of mesh with the tooth portion 56*b* on the sector rack 56 of one wheel support member 7, as shown in FIG. 13. Therefore, the pinion 45 rotates idly, the wheel support members 7 remain in the lifting-up positions, and the rightward/leftward travel wheels 8 remain in higher positions than the front wheels 2 and the rear wheels 3. Due to this, the front wheels 2 and the rear wheels 3 (3L, 3R) keep contacting the ground. The right wheel 3L rotates in the reverse direction, while the right wheel 3R rotates in the normal direction, with the result that the body 1 turns counterclockwise.

In contrast, when the wheel support members 7 are in the lifting-down positions, the pinion 45 is in mesh with the tooth portion 56*b* on the sector rack 56 of the wheel support member 7 for the left wheels, as shown in FIG. 14. Owing to this, upon the rotation of the pinion 45, the sector rack 56 is rotated in the direction of the arrow Y3. This rotation causes the clockwise rotation of the wheel support member 7 for the left wheels on one support shaft 6. Since the sector gears 57 and 58 are in mesh with each other, the wheel support member 7 for the right wheels rotates counterclockwise on the other support shaft 6. Finally, the pinion 45 disengages from the tooth portion 56*b* and becomes the state shown in FIG. 13 due to the coil spring 59. As a result, the rightward/leftward travel wheels 8 come up to higher positions shown in FIG. 13 than the front wheels 2 and the rear wheels 3. The front wheels 2 and the rear wheels 3 ground with the rear wheels 3L and 3R rotating, and the toy car turns counterclockwise.

(5) Rightward Traveling

The button 303B of the control box 302 is tilted in the R direction. The input section 104 detects this operation, and sends an operation signal to the control section 105. In this case, the input section 104 detects the operation of the button 303B by priority over the operation of the button 303A, and outputs an operation signal associated with the button 303B when the buttons 303A and 303B are operated simultaneously.

The control section 105 generates a control signal for rotating the motor 21 in the normal direction at the speed according to the tilt angle of the joystick 103B, and supplies the control signal to the modulating circuit 106. The modulating circuit 106 modulates the control signal and sends the modulated signal from the antenna 107.

The antenna 112 receives the transmitted radio waves, the tuner 108 tunes those radio waves, and the IF circuit 109 converts the output signal to the intermediate frequency signal and supplies it to the AF demodulating circuit 110 in order to demodulate the control signal.

The controller 111 outputs a normal rotation signal to the motor 21 in response to the control signal. In response to this normal rotation signal, the motor 21 rotates in the normal direction and causes the driving gear 22, intermediate gear 24, transmission gears 25, intermediate gears 26, 27 and driven gears 28 of the leftward/rightward travel wheels driving device 20 (FIGS. 6 and 7) to rotate the right/left travel wheels 8 in the normal direction.

As the intermediate gear 24 rotates in the direction of the arrow Y2 showing the normal rotational direction, the planetary gear 46 rotates around the rotary shaft 23 together with the arm 46*a* in the direction of the arrow Y2, and meshes with the intermediate gear 48. Due to this, upon the rotation of the motor 21, the driven gear 47 is rotated by the intermediate gear 24, the driving transformation gear 29, the planetary gear 46 and the intermediate gear 48 in the direction opposite to that of the arrow Y2, i.e., in the same direction as that of the arrow X2.

As shown in FIG. 9, the rotation of the driven gear 47 is transmitted to the second driven gear 53 through the first transmission gear 50 and intermediate gears 51 and 52 of the traveling direction changeover transmission mechanism 49, and the pinion 54 which is in mesh with the gear 47 (FIGS. 12 and 13) is rotated.

As shown in FIG. 13, when the wheel support members 7 are in the lifting-up positions, the pinion 54 is in mesh with the tooth portion 56*a* of the sector rack 56. Due to this, the sector rack 56 is rotated in the direction of the arrow X3, and the wheel support member 7 for the left wheels rotates counterclockwise. Upon this rotation, the support member 7 for the right wheels is rotated by the sector gears 57 and 58 which are in mesh with each other. Finally, the pinion 54 disengages from the tooth portion 56*a*, the wheel support members 7 come to the lifting-down positions shown in FIG. 14 and keep those positions with the wheel support members being biased by the coil spring 59, as shown in FIG. 8.

Therefore, the right/left travel wheels 8 come down with rotating, and the toy car travels rightward upon grounding of the right/left travel wheels 8.

In the case where the wheel support members 7 are in the lifting-down positions shown in FIG. 14 from the beginning, the pinion 54 is out of mesh with the tooth portion 56*a* and rotates idly, and the wheel support members 7 remain in the lifting-down positions. Consequently, the toy car travels rightward without entailing the lifting-up and lifting-down actions of the wheel support members 7.

(6) Leftward Traveling

When the button 303B of the control box 302 is tilted in the L direction, the controller 111 outputs a reverse rotation signal to the motor 21. The motor 21 reverses so as to rotate the rightward/leftward travel wheels 8 in the reverse direction. Moreover, as shown in FIG. 11, the driving transformation gear 29 causes the arm 46*a* to rotate the planetary gear 46 around the rotary shaft 23 in the direction of the arrow X2 such that the planetary gear 46 meshes with the driven gear 47. Consequently, the rotation of the intermediate gear 24 is transmitted to the driven gear 47 through the gears 29 and 46, and the driven gear 47 is rotated in the same direction as that in the case of rotating the motor 21 in the normal direction. The other operations are the same as those in the case of rotating the motor 21 in the normal direction, and the toy car travels leftward.

The forward traveling speed and the backward traveling speed are determined by the tilt angle of the button 103B.

(7) Halt

While neither the button 303A nor 303B of the control box 302 is being operated, the input section 104 outputs no operation signal. The controller 105 of the control device 101 outputs a control signal for stopping the supply of a current to the motors 11L, 11R and 21. In response to this, the controller 111 stops the supply of the electric power to the motors 11L, 11R and 21 such that the toy car halts.

According to the structure of the fourth embodiments, the toy car can be moved in various directions using three motors. Moreover, switching between the forward/backward traveling and the rightward/leftward traveling can be instantly performed. It is also possible to turn the body.

The present invention is not limited to the above-described first to fourth embodiments, and various modifications and applications are possible.

For example, the number of motors is not limited to 2 or 3, and is arbitrary. Further, in the first to fourth embodiments, motors which control a rotational direction in accordance with the polarity of a supplied voltage and which control a rotational speed in accordance with a voltage are employed as motors 11 (11L, 11R) and 21. However, other arbitrary types of motors can be adopted.

Moreover, the structures by which motive power is transmitted from the motors to the wheels and a mechanism for driving the wheel support members are not limited to ones having gears, and may use a belt, a cam, a shaft, and/or the like.

Furthermore, the toy cars of the first to fourth embodiments are ones of a rear-wheel drive type. However, they may be a front-wheel drive type or a four-wheel drive type. Moreover, the front wheels and the rear wheels may be coupled with belts and caterpillars so that the rotation of the rear wheels is transmitted to the front wheels or so that the rotation of the front wheels is transmitted to the rear wheels.

A structure different from that shown in FIGS. 7 and 8 can be used as a mechanism for rotating the wheel support members 7 on the shafts 6. For example, it is possible to employ the structure wherein a rack is vertically arranged between the wheel support members 7 and wherein the sector gears 57 and 58 of the wheel support members 7 and two pinions 45 and 54 of the elevation driving device are meshed with the rack. According to this structure, the rack moves upward and downward in accordance with the rotation of the pinions 45 and 54, and as the rack moves upward and downward, the sector gears 57 and 58 which are in mesh with the rack move upward and downward such that the wheel support members 7 rotate.

An elevating mechanism having another desired structure may lift up and down the right and left wheels 8. For example, a link mechanism or a cam mechanism may lift them up and down. It is also possible that a vertical guide is formed in the opening in the body, and that a wheel support member to which the right and left wheels are rotatably attached is moved upward and downward along the vertical guide. In the latter case, the wheel support member may be provided with right and left driving motors, and the rotation of the motors may be transmitted through belts and/or the like to the driving gear of the second transmission mechanism.

A toy car with the front and rear wheels and the right and left wheels has been described. However, the invention is applicable also to a toy car having the front and rear wheels and the wheels oriented (directed) obliquely to the right, and the orientations (directions) of the wheels are arbitrary.

What is claimed is:

1. A toy car comprising:

a body having front wheels and rear wheels;

a first wheel driver which rotates one of said front wheels and said rear wheels;

a wheel holder including rightward/leftward travel wheels for permitting said toy car to travel rightward and leftward, said rightward/leftward travel wheels having orientations different from orientations of said front and rear wheels;

a second wheel driver which rotates said rightward/leftward travel wheels; and an elevator for bringing said rightward/leftward travel wheels upwardly in order to enable said toy car to travel on said front and rear wheels, and for bringing said rightward/leftward travel wheels downwardly in order to enable said toy car to travel on said rightward/leftward travel wheels, wherein:

said first wheel driver includes at least one first motor which is rotatable in a normal direction and a reverse direction and a first transmission transmitting the rotation of said at least one first motor to one of said front wheels and said rear wheels;

said second wheel driver includes a second motor which is rotatable in the normal direction and the reverse direction and a second transmission transmitting the rotation of said second motor to said rightward/leftward travel wheels; and said elevator includes a rotation converter converting rotations, in the normal and reverse directions, of said first motor to rotations in the same direction and driving wheel support members with the converted rotations so that said rightward/leftward travel wheels moves upwardly, and converting rotations, in the normal and reverse directions, of said second motor to rotations in the same direction and for driving said rightward/leftward travel wheels downwardly; and said first wheel driver includes means for making rotational directions of a right wheel and a left wheel among said front and rear wheels different from each other.

2. A toy car comprising:

a body having front wheels and rear wheels;

a first wheel driver which rotates one of said front wheels and said rear wheels;

a wheel holder including rightward/leftward travel wheels for permitting said toy car to travel rightward and leftward, said rightward/leftward travel wheels having orientations different from orientations of said front and rear wheels;

a second wheel driver which rotates said rightward/leftward travel wheels; and an elevator for bringing said rightward/leftward travel wheels upwardly in order to enable said toy car to travel on said front and rear wheels, and for bringing said rightward/leftward travel wheels downwardly in order to enable said toy car to travel on said rightward/leftward travel wheels, wherein, said first wheel driver includes at least one first motor which is rotatable in a normal direction and a reverse direction and a first transmission transmitting the rotation of said at least one first motor to one of said front wheels and said rear wheels;

said second wheel driver includes a second motor which is rotatable in the normal direction and the reverse direction and a second transmission transmitting the rotation of said second motor to said rightward/leftward travel wheels; and said elevator includes a rotation converter converting rotations, in the normal and reverse directions, of said first motor to rotations in the same direction and driving wheel support members with the converted rotations so that said rightward/leftward travel wheels moves upwardly, and converting rotations, in the normal and reverse directions, of said second motor to rotations in the same direction and for driving said wheel support members so that said rightward/leftward travel wheels moves downwardly.

3. The toy car according to claim 2, further comprising:

a control box having an input section, operated by a user, for creating an operation signal, and a sending means for converting said operation signal to a radio signal that is transmitted to said toy car;

a demodulator arranged on said body, for receiving the radio signal from said sending means and demodulating a control signal; and a controller controlling said first and second wheel drivers and said elevator in accordance with the control signal demodulated by said demodulator.

4. The toy car according to claim 2, wherein:

said first wheel driver and said elevator moves the rightward/leftward travel wheels upwardly while rotating one of the front wheels and the rear wheels, and said second wheel driver and second elevator moves the rightward/leftward travel wheels downwardly while rotating the rightward/leftward travel wheels.

5. A toy car comprising:

a body having front wheels and rear wheels;

a first wheel driver which rotates one of said front wheels and said rear wheels;

a wheel holder including rightward/leftward travel wheels for permitting said toy car to travel rightward and leftward, said rightward/leftward travel wheels having orientations different from orientations of said front and rear wheels;

a second wheel driver which rotates said rightward/leftward travel wheels; and an elevator for bringing said rightward/leftward travel wheels upwardly in order to enable said toy car to travel on said front and rear wheels, and for bringing said rightward/leftward travel wheels downwardly in order to enable said toy car to travel on said rightward/leftward travel wheels;

wherein:

said first wheel driver includes at least one first motor which is rotatable in a normal direction and a reverse direction and a first rotation transmission transmitting the rotation of said at least one first motor to one of said front wheels and said rear wheels;

said wheel holder includes two wheel support members arranged at said body horizontally;

each of said wheel support members has two ends, one end being supported on said body by a support shaft and the other end holding one of said rightward/leftward travel wheels; and said second wheel driver includes a second motor which is rotatable in the normal direction and the reverse direction and a second rotation transmission transmitting the rotation of said second motor to said rightward/leftward travel wheels; and said elevator rotates each of said wheel support members around said support shaft;

said elevator includes a first changeover mechanism converting rotations, in the normal and reverse directions, of said at least one first motor to rotations in the same direction, and rotating each of said wheel support members with the rotations converted by said first changeover mechanism so that said other end travels upwardly, a second changeover mechanism converting rotations, in the normal and reverse directions, of said second motor to rotations in the same direction, and rotating each of said wheel support members with the rotations converted by said second changeover mechanism so that said other end moves downwardly.

6. The toy car according to claim 5, wherein:

said first changeover mechanism includes a first driving gear which is rotated by said at least one first motor, a first driven gear and a first intermediate gear which are in mesh with each other, and a first planetary gear which is in mesh with said first driving gear, said first planetary gear being in mesh with said first intermediate gear while said at least one first motor is rotating in the normal direction and being in mesh with said first driven gear while said at least one first motor is rotating in the reverse direction; and said second changeover mechanism includes a second driving gear which is rotated by said second motor, a second driven gear and a second intermediate gear which are in mesh with each other, and a second planetary gear which is in mesh with said second driving gear, said second planetary gear being in mesh with said second intermediate gear while said second motor is rotating in the normal direction and being in mesh with said second driven gear while said second motor is rotating in the reverse direction.

7. The toy car according to claim 5, wherein:

said first wheel driver and said elevator brings the rightward/leftward travel wheels upwardly while rotating one of the front wheels and the rear wheels, and said second wheel driver and said elevator brings the rightward/leftward travel wheels downwardly while rotating the rightward/leftward travel wheels.

8. A toy car comprising:

a body having front wheels and rear wheels;

a first wheel driver which rotates one of said front wheels and said real wheels;

a wheel holder including rightward/leftward travel wheels for permitting said toy car to travel rightward and leftward, said rightward/leftward travel wheels having orientations different from orientations of said front and rear wheels;

a second wheel driver which rotates said rightward/leftward travel wheels; and an elevator for bringing said rightward/leftward travel wheels upwardly in order to enable said toy car to travel on said front and rear wheels, and for bringing said rightward/leftward travel wheels downwardly in order to enable said toy car to travel on said rightward/leftward travel wheels;

wherein:

said wheel holder includes two wheel support members arranged at said body horizontally;

each of said wheel support members has two ends, one end being supported on said body by a support shaft and the other end holding one of said rightward/leftward travel wheels; and said elevator rotates each of said wheel support members around said support shaft;

said rear wheels include a first rear wheel and a second rear wheel that are supported on said body by separate axles; and said first wheel driver includes rotation means for rotating said first rear wheel in the same direction as a rotational direction of said second rear wheel, body turning means for turning said body by rotating said first rear wheel in a different direction from the rotational direction of said second rear wheel, and a selection means for coupling said first rear wheel selectively to said rotation means and said body turning means.

9. A toy car comprising:

a body;

second wheels oriented first direction;

second wheels oriented in a second direction different from said first direction;

a changeover section holding said second wheels and keeping said second wheels in positions which are switched between first positions in which said second wheels are lower than said first wheels and second positions in which said second wheels are higher than said first wheels; and a driver driving said second wheels when said changeover section keeps said second wheels in the first positions, and driving said first wheels when said changeover section keeps said second wheels in the second positions; wherein:

said driver includes a first motor, a first transmission transmitting rotation of said first motor to said first wheels, a second motor, and a second transmission transmitting rotation of said second motor to said second wheels; and said changeover section drives said second wheels up to said second positions with the rotation of said first motor, and drives said second wheels down to said first positions with the rotation of said second motor; and said driver includes means for making rotary directions of at least two said first wheels different from each other.

10. A toy car comprising:

a body;

first wheels oriented in a first direction and being capable of supporting the body by themselves;

second wheels oriented in a second direction different from the first direction and being capable of supporting the body by themselves;

a driver which moves at least either of first and second wheels upwardly and downwardly, drives the first wheels when said first wheels are lower than said second wheels to run the body in the first direction, and drives the second wheels when said second wheels are lower than said first wheels to run the body in the second direction;

said driver includes:

a first wheel driver which rotates said first wheels;

a second wheel driver which rotates said second wheels; and an elevator bringing said second wheels upwardly in order to enable said toy car to travel on said first wheels, and bringing said second wheels downwardly in order to enable said toy car to travel on said second wheels; wherein said first wheel driver includes a first motor which is rotatable in a normal direction and a reverse direction and a first transmission transmitting the rotation of said first motor to said first wheels;

said second wheel driver includes a wheel support member which supports said second wheels and a second motor which is rotatable in the normal direction and the reverse direction and second transmission transmitting the rotation of said second motor to said second wheels; and said elevator converts rotations, in the normal and reverse directions, of said first motor to rotations in the same direction and driving said wheel support members with the converted rotations so that said second wheels moves upwardly, and converts rotations, in the normal and reverse directions, of said second motor to rotations in the same direction and for driving said wheel support members with the converted rotations so that said second wheels moves downwardly.

11. A toy car comprising:

a body;

first wheels oriented in a first direction and being capable of supporting the body by themselves;

second wheels oriented in a second direction different from the first direction and being capable of supporting the body by themselves;

a driver which moves at least either of first and second wheels upwardly and downwardly, drives the first wheels when said first wheels are lower than said second wheels to move the body in the first direction, and drives the second wheels when said second wheels are lower than said first wheels to move the body in the second direction, wherein:

said driver includes:

a first motor which is rotatable in a normal direction and a reverse direction;

a first transmission transmitting the rotation of said first motor to one of the front wheels and the rear wheels;

a second motor which is rotatable in the normal direction and the reverse direction;

a second transmission transmitting the rotation of said second motor to said second wheels; and an elevator which includes a first changeover mechanism converting rotations, in the normal and reverse directions, of said first motor to rotations in the same direction, and rotates each of said wheel support members with the rotations converted by said first changeover mechanism so that said other end moves upwardly, a second changeover mechanism converting rotations, in the normal and reverse directions, of said second motor to rotations in the same direction, and rotating each of said wheel support members with the rotations converted by said second changeover mechanism so that said other end travels downwardly.

12. The toy car according to claim 11, wherein:

said first changeover mechanism includes a first driving gear which is rotated by said first motor, a first driven gear and a first intermediate gear which are in mesh with each other, and a first planetary gear which is in mesh with said first driving gear, said first planetary gear being in mesh with said first intermediate gear while said at least one first motor is rotating in the normal direction and being in mesh with said first driven gear while said at least one first motor is rotating in the reverse direction; and said second changeover mechanism includes a second driving gear which is rotated by said second motor, a second driven gear and a second intermediate gear which are in mesh with each other, and a second planetary gear which is in mesh with said second driving gear, said second planetary gear being in mesh with said second intermediate gear while said second motor is rotating in the normal direction and being in mesh with said second driven gear while said second motor is rotating in the reverse direction.

13. The toy car according to claim 11, wherein:

said elevator includes:

a first driven gear to which the rotation of said first motor is transmitted;

a second driven gear to which the rotation of said second motor is transmitted;

first and second pinions which are in mesh with said first and second driven gears;

a sector rack, on an outer circumference of which first and second tooth portions, capable of engaging with and disengaging from said first and second pinions, are formed with being spaced from each other, and which is formed on one of said wheel support members; and gears formed on those side surfaces of said wheel support members which face each other, and being in mesh with each other.

14. A toy car comprising:

a body;

first wheels oriented in a first direction and being capable of supporting the body by themselves;

second wheels oriented in a second direction different from the first direction and being capable of supporting the body by themselves;

a driver which moves at least either of first and second wheels upwardly and downwardly, drives the first wheels when said first wheels are lower than said second wheels to run the body in the first direction, and drives the second wheels when said second wheels are lower than said first wheels to run the body in the second direction, wherein:

said first wheels include front wheels and rear wheels, said rear wheels have a first rear wheel and a second rear wheel that are supported on said body by separate axles; and said driver includes rotation means for rotating the first rear wheel in the same direction as a rotational direction of said second rear wheel, body turning means for turning said body by rotating said first rear wheel in a different direction from the rotational direction of said second rear wheel, and a selection means for coupling said first rear wheel selectively to said rotation means and said body turning means.

* * * * *

UNITED STATES PATENT AND TRADEMARK OFFICE

CERTIFICATE OF CORRECTION

PATENT NO. : 5,868,600

DATED : February 9, 1999

INVENTOR(S) : Kazuhiko Watanabe

It is certified that error appears in the above-indentified patent and that said Letters Patent is hereby corrected as shown below:

Column 30, line 3, "second wheels oriented first direction" should be -- first wheels oriented in a first direction: --

Signed and Sealed this

First Day of June, 1999

*Attest:*

Q. TODD DICKINSON

*Attesting Officer*

*Acting Commissioner of Patents and Trademarks*